US010375507B2

(12) United States Patent
Fujii et al.

(10) Patent No.: US 10,375,507 B2
(45) Date of Patent: Aug. 6, 2019

(54) MEASUREMENT DEVICE AND MEASUREMENT METHOD

(71) Applicant: JVC KENWOOD Corporation, Yokohama-shi, Kanagawa (JP)

(72) Inventors: Yumi Fujii, Yokahama (JP); Hisako Murata, Yokohama (JP); Masaya Konishi, Yokohama (JP)

(73) Assignee: JVC KENWOOD CORPORATION, Kanagawa (JP)

( * ) Notice: Subject to any disclaimer, the term of this patent is extended or adjusted under 35 U.S.C. 154(b) by 0 days.

(21) Appl. No.: 16/044,366

(22) Filed: Jul. 24, 2018

(65) Prior Publication Data

US 2018/0332426 A1 Nov. 15, 2018

Related U.S. Application Data

(63) Continuation of application No. PCT/JP2016/004901, filed on Nov. 16, 2016.

(30) Foreign Application Priority Data

Jan. 26, 2016 (JP) ..... 2016-012043

(51) Int. Cl.
*H04S 7/00* (2006.01)
*H04R 1/40* (2006.01)
(Continued)

(52) U.S. Cl.
CPC ..... *H04S 7/304* (2013.01); *H04R 1/406* (2013.01); *H04R 3/005* (2013.01); *H04R 5/033* (2013.01);
(Continued)

(58) Field of Classification Search
CPC ..... H04R 5/04; H04R 3/005; H04R 5/033; H04R 1/406; H04S 7/302; H04S 2420/01;
(Continued)

(56) References Cited

U.S. PATENT DOCUMENTS

2006/0056638 A1* 3/2006 Schobben ..... H04S 1/002 381/17

FOREIGN PATENT DOCUMENTS

| | | | |
|---|---|---|---|
| JP | 2002-135898 | A | 5/2002 |
| JP | 2002-209300 | A | 7/2002 |
| WO | 2004/028205 | A2 | 4/2004 |

OTHER PUBLICATIONS

Weinzierl, S. et al. "Generalized Multiple Sweep Measurement" Audio Engineering Society Convention 126; May 2009, 14 pages.
(Continued)

*Primary Examiner* — Paul Kim
(74) *Attorney, Agent, or Firm* — Procopio, Cory, Hargreaves & Savitch LLP

(57) ABSTRACT

A transfer characteristics measurement unit measures first transfer characteristics from left and right sound sources to left and right microphones, respectively. An environmental measurement unit picks up environmental measurement signals output from the left and right sound sources with use of the left and right microphones, sets an amplitude level of transfer characteristics measurement signals and a tap length of the transfer characteristics, picks up sounds with use of the left and right microphones in a state where no sound is output from the left and right sound sources, and measures second transfer characteristics. A correction unit corrects a low frequency range of the first transfer characteristics based on the second transfer characteristics.

10 Claims, 23 Drawing Sheets

(51) Int. Cl.

| | |
|---|---|
| ***H04R 3/00*** | (2006.01) |
| ***H04R 5/033*** | (2006.01) |
| ***H04R 5/04*** | (2006.01) |
| ***H04S 3/00*** | (2006.01) |

(52) U.S. Cl.
CPC ..... *H04R 5/04* (2013.01); *H04S 3/008* (2013.01); *H04S 7/302* (2013.01); *H04S 2400/01* (2013.01); *H04S 2400/15* (2013.01); *H04S 2420/01* (2013.01)

(58) Field of Classification Search
CPC ..... H04S 2400/01; H04S 3/008; H04S 2400/15; H04S 7/304
USPC ..... 381/303
See application file for complete search history.

(56) References Cited

OTHER PUBLICATIONS

Zhang, M. et al. "HRTF Measurement on KEMAR Manikin" Proceedings of Acoustics 2009, Nov. 25, 2009; 8 pages; Adelaide, Australia.

* cited by examiner

200

MEASUREMENT DEVICE AND MEASUREMENT METHOD

CROSS REFERENCE TO RELATED APPLICATION

This application is a Continuation of International Patent Application No. PCT/JP2016/004901, filed on Nov. 16, 2016, and is based upon and claims the benefit of priority from Japanese patent application No. 2016-012043, filed on Jan. 26, 2016, the disclosure of which is incorporated herein in its entirety by reference.

BACKGROUND

The present disclosure relates to a measurement device and a measurement method.

Sound localization techniques include an out-of-head localization technique, which localizes sound images outside the head of a listener by using headphones. The out-of-head localization technique localizes sound images outside the head by canceling characteristics from the headphones to the ears and giving four characteristics from stereo speakers to the ears. Patent Literature 1 (Japanese Unexamined Patent Application Publication No. 2002-209300) discloses a method using a head-related transfer function (HRTF) and an ear canal transfer function as a method for localizing sound images outside the head. Further, it is known that the HRTF varies widely from person to person, and particularly, the variation of the HRTF due to a difference in auricle shape is significant.

In out-of-head localization reproduction, transfer characteristics measurement signals (impulse sounds etc.) that are output from 2-channel (which is referred to hereinafter as "ch") speakers are recorded by microphones placed on the listener's ears. Then, a head-related transfer function is calculated based on impulse responses, and a filter is generated. The generated filter is convolved to 2-ch music signals, thereby implementing out-of-head localization reproduction.

The characteristics can be measured accurately by placing microphones on the ears (preferably, at the entrances of the ear canals) of a listener. However, it is complicated to carry out measurement with microphones at the entrances of the ear canals of a listener. Patent Literature 2 discloses a method of measuring the transfer characteristics by headphones equipped with microphones.

SUMMARY

Measurement of such a transfer function (which is also called transfer characteristics) is generally carried out in a special measurement room in which a sound source such as speakers is placed. For example, a measurement room is an audio room where acoustic characteristics of the room are calculated, an anechoic room where sound absorbing material is adhered to the wall to eliminate reflections in the room or the like. In a measurement room, transfer characteristics measurement signals (impulse sounds etc.) are generated from speakers. Then, impulse responses are measured by use of microphones placed at the entrances of the ear canals or at the entrances of the eardrums of a listener or a dummy head. Generally, such a measurement room has an indoor environment with fewer unwanted sound reflections and echoes and having a speaker layout that takes acoustic characteristics into consideration.

By using the headphones and microphones disclosed in Patent Literature 2 (Japanese Unexamined Patent Application Publication No. 2002-135898), it is possible to measure impulse responses in an environment other than a measurement room. For example, impulse responses can be measured in various environments including an environment where a listener actually listens to sounds, such as a room at home. However, in the room shape or speaker layout which does not take acoustic characteristics into consideration, there is a case where unexpected reflected sounds occur. There is also a case where environmental sounds such as background noise and sudden noise are measured as noise. This can cause a decrease in the measurement accuracy of transfer characteristics necessary for sound localization.

A measurement device according to one aspect of an embodiment includes a transfer characteristics measurement unit configured to measure first transfer characteristics from left and right sound sources to left and right microphones, respectively, by picking up transfer characteristics measurement signals output from the left and right sound sources with use of the left and right microphones, an environmental measurement unit configured to perform first environmental measurement that picks up environmental measurement signals output from the left and right sound sources with use of the left and right microphones and second environmental measurement that picks up sounds with use of the left and right microphones in a state where no sound is output from the left and right sound sources, sets an amplitude level of the transfer characteristics measurement signals and a tap length of the first transfer characteristics based on results of the first environmental measurement, and measures second transfer characteristics based on results of the second environmental measurement, and a correction unit configured to correct a low frequency range of the first transfer characteristics based on the second transfer characteristics.

A measurement method according to one aspect of an embodiment is a measurement method for measuring first transfer characteristics between left and right sound sources and left and right microphones, the method including an environmental measurement step of performing first environmental measurement that picks up environmental measurement signals output from the left and right sound sources with use of the left and right microphones and second environmental measurement that picks up sounds with use of the left and right microphones in a state where no sound is output from the left and right sound sources, setting an amplitude level of transfer characteristics measurement signals and a tap length of the first transfer characteristics from the left and right sound sources to the left and right microphones based on results of the first environmental measurement, and measuring second transfer characteristics based on results of the second environmental measurement, a transfer characteristics measurement step of measuring the first transfer characteristics by outputting, from the left and right sound sources, the transfer characteristics measurement signals set based on results of the first environmental measurement, and picking up the transfer characteristics measurement signals with use of the left and right microphones, respectively, and a correction step of correcting a low frequency range of the first transfer characteristics based on the second transfer characteristics.

According to the embodiment, it is possible to provide a measurement device and a measurement method that are capable of measuring appropriate transfer characteristics for an environment.

DETAILED DESCRIPTION

The overview of an out-of-head localization process, which is an example of a sound localization device according to an embodiment, is described hereinafter.

The out-of-head localization process according to this embodiment performs out-of-head localization by using personal spatial acoustic transfer characteristics (which is also called a spatial acoustic transfer function) and ear canal transfer characteristics (which is also called an ear canal transfer function). In this embodiment, out-of-head localization is achieved by using the spatial acoustic transfer characteristics from speakers to a listener's ears and the ear canal transfer characteristics (which is also called an ear canal transfer function) when headphones are worn.

In this embodiment, the ear canal transfer characteristics, which are characteristics from a headphone speaker unit to the entrance of the ear canal when headphones are worn are used. By carrying out filter processing with use of the inverse characteristics of the ear canal transfer characteristics (which are also called an ear canal correction function), it is possible to cancel the ear canal transfer characteristics.

An out-of-head localization device according to this embodiment is an information processor such as a personal computer, a smart phone, a tablet PC or the like, and it includes a processing means such as a processor, a storage means such as a memory or a hard disk, a display means such as a liquid crystal monitor, an input means such as a touch panel, a button, a keyboard and a mouse, and an output means with headphones or earphones.

First Embodiment

Figure 1:
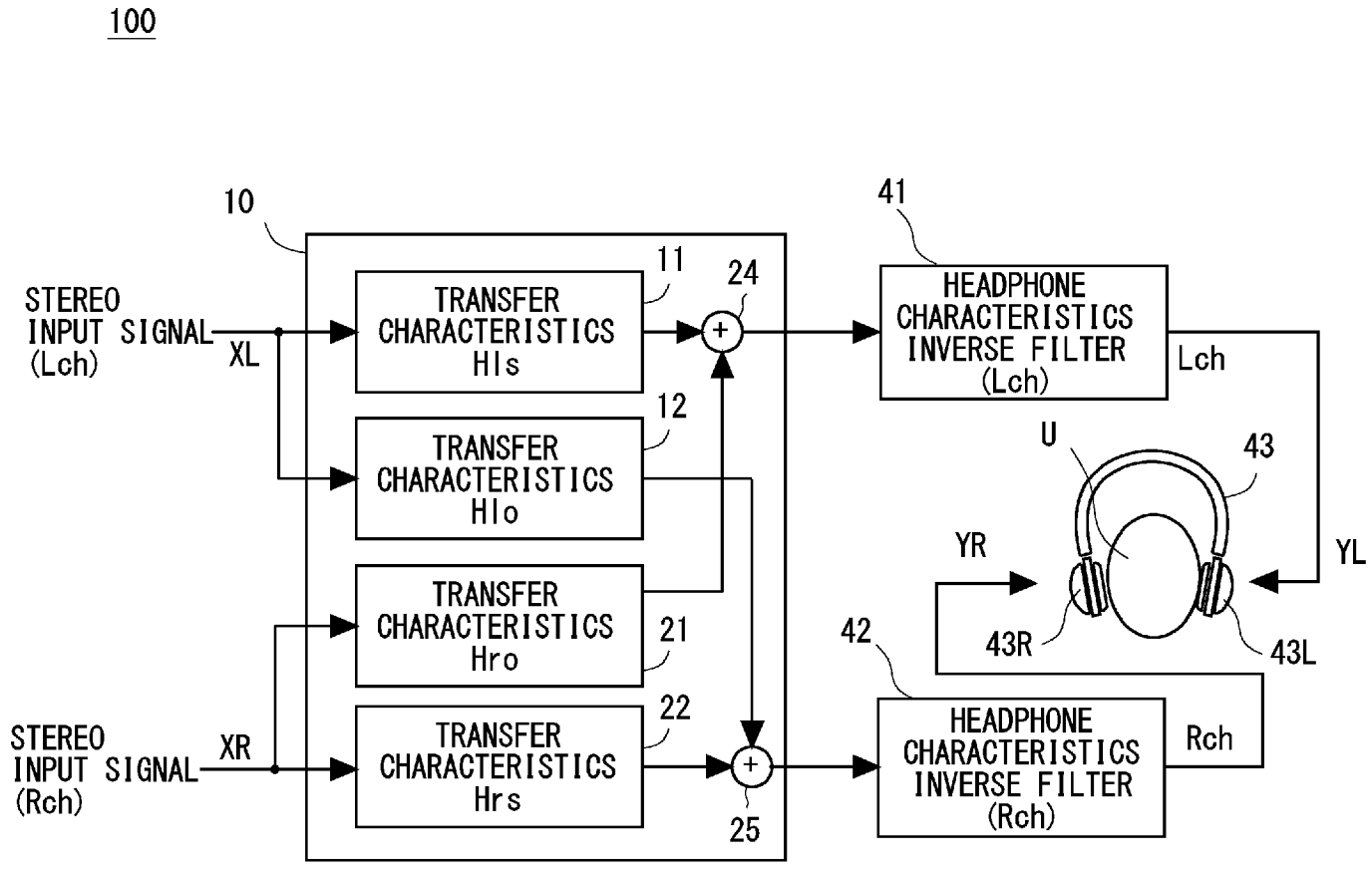
FIG. 1 is a block diagram showing an out-of-head localization device according to an embodiment.

FIG. 1 shows an out-of-head localization device 100, which is an example of a sound field reproduction device according to this embodiment. FIG. 1 is a block diagram of the out-of-head localization device. The out-of-head localization device 100 reproduces sound fields for a user U who is wearing headphones 43. Thus, the out-of-head localization device 100 performs sound localization for L-ch and R-ch stereo input signals XL and XR. The L-ch and R-ch stereo input signals XL and XR are music reproduction signals that are output from a CD (Compact Disc) player or the like. Note that the out-of-head localization device 100 is not limited to a physically single device, and a part of processing may be performed in a different device. For example, a part of processing may be performed by a personal computer or the like, and the rest of processing may be performed by a DSP (Digital Signal Processor) included in the headphones 43 or the like.

The out-of-head localization device 100 includes an out-of-head localization unit 10, a filter unit 41, a filter unit 42, and headphones 43.

The out-of-head localization unit 10 includes convolution calculation units 11 to 12 and 21 to 22, and adders 24 and 25. The convolution calculation units 11 to 12 and 21 to 22 perform convolution processing using the spatial acoustic transfer characteristics. The stereo input signals XL and XR from a CD player or the like are input to the out-of-head localization unit 10. The spatial acoustic transfer characteristics are set to the out-of-head localization unit 10. The out-of-head localization unit 10 convolves the spatial acoustic transfer characteristics to the stereo input signal XL, XR of each channel. The spatial acoustic transfer characteristics may be a head-related transfer function (HRTF) measured in the head or auricle of the user U, or may be the head-related transfer function of a dummy head or a third person. Those transfer characteristics may be measured on sight, or may be prepared in advance.

The spatial acoustic transfer characteristics include four transfer characteristics Hls, Hlo, Hro and Hrs. The four transfer characteristics can be calculated by using a measurement device, which is described later.

The convolution calculation unit 11 convolves the transfer characteristics Hls to the L-ch stereo input signal XL. The convolution calculation unit 11 outputs convolution calculation data to the adder 24. The convolution calculation unit 21 convolves the transfer characteristics Hro to the R-ch stereo input signal XR. The convolution calculation unit 21 outputs convolution calculation data to the adder 24. The adder 24 adds the two convolution calculation data together, and outputs the data to the filter unit 41.

The convolution calculation unit 12 convolves the transfer characteristics Hlo to the L-ch stereo input signal XL. The convolution calculation unit 12 outputs convolution calculation data to the adder 25. The convolution calculation unit 22 convolves the transfer characteristics Hrs to the R-ch stereo input signal XR. The convolution calculation unit 22 outputs convolution calculation data to the adder 25. The adder 25 adds the two convolution calculation data together, and outputs the data to the filter unit 42.

An inverse filter that cancels the ear canal transfer characteristics is set to the filter units 41 and 42. Then, the inverse filter is convolved to the reproduction signals on which processing in the out-of-head localization unit 10 has been performed. The filter unit 41 convolves the inverse filter to the L-ch signal from the adder 24. Likewise, the filter unit 42 convolves the inverse filter to the R-ch signal from the adder 25. The inverse filter cancels the characteristics from a headphone unit to microphones when the headphones 43 are worn. Specifically, when microphones are placed at the entrance of the ear canal, the transfer characteristics between the entrance of the ear canal of a user and a reproduction unit of headphones or between the eardrum and a reproduction unit of headphones are cancelled. The inverse filter may be calculated from a result of measuring the ear canal transfer function in the auricle of the user U on sight, or the inverse filter of headphone characteristics calculated from an arbitrary ear canal transfer function of a dummy head or the like may be prepared in advance.

The filter unit 41 outputs the corrected L-ch signal to a left unit 43L of the headphones 43. The filter unit 42 outputs the corrected R-ch signal to a right unit 43R of the headphones 43. The user U is wearing the headphones 43. The headphones 43 output the L-ch signal and the R-ch signal toward the user U. It is thereby possible to reproduce the sound image that is localized outside the head of the user U.

(Measurement Device)

Figure 2:
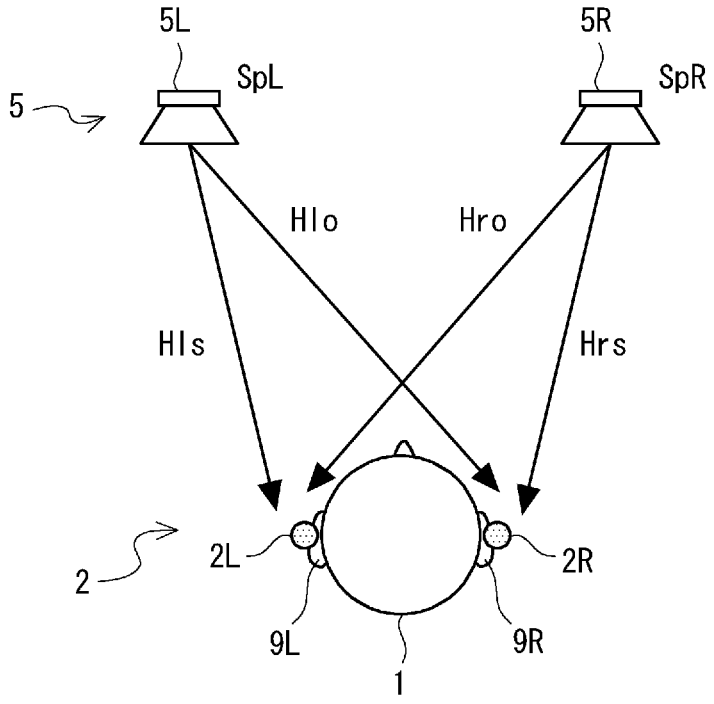
FIG. 2 is a view showing the structure of a measurement device for measuring transfer characteristics.
Figure 3:
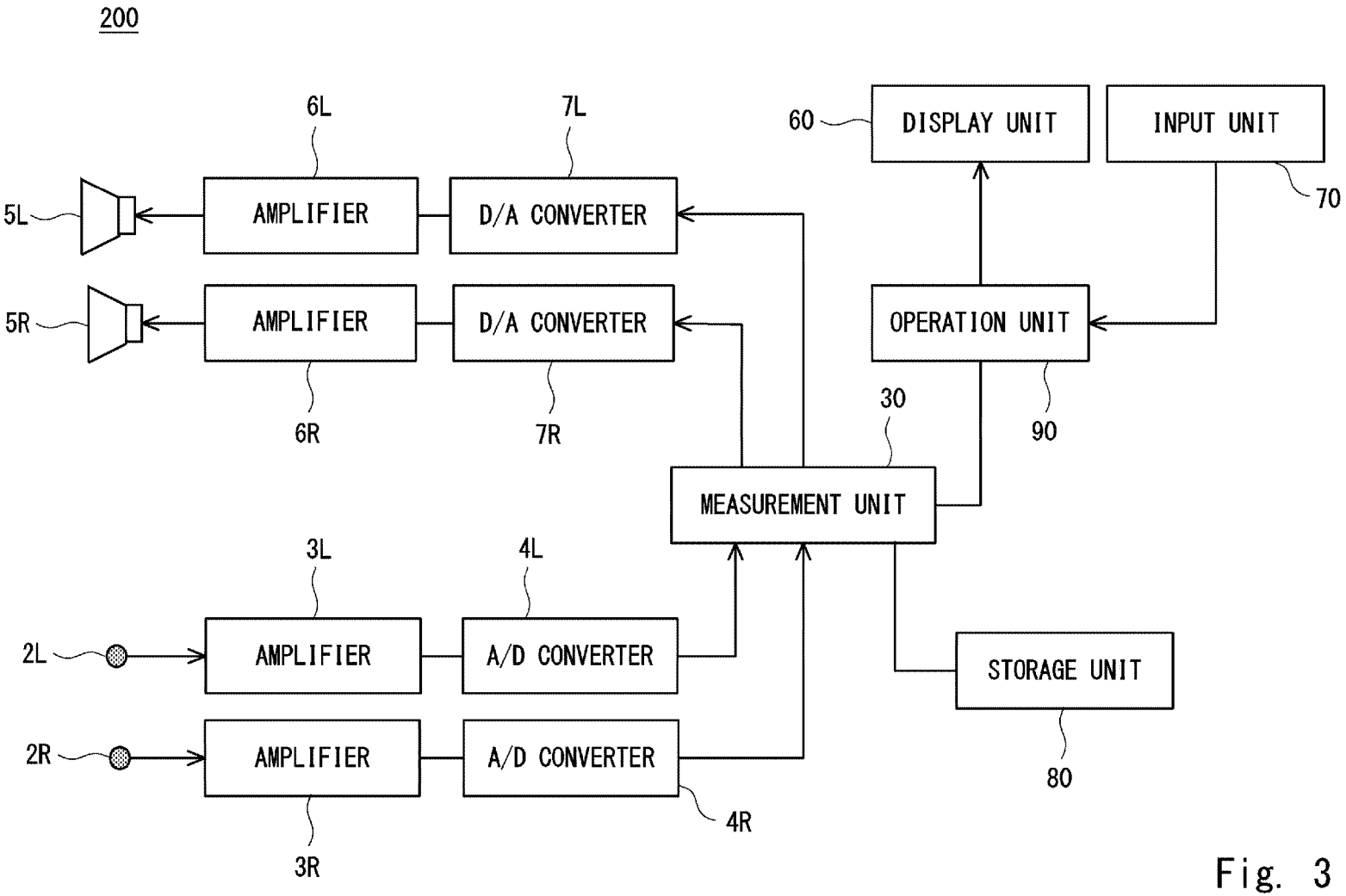
FIG. 3 is a control block diagram showing the structure of a measurement device.

A measurement device that measures spatial acoustic transfer characteristics (which are referred to hereinafter as transfer characteristics) is described hereinafter with reference to FIGS. 2 and 3. FIG. 2 is a view schematically showing the structure of a measurement device. FIG. 3 is a block diagram showing the control structure of a measurement device 200. Note that the measurement device 200 may be the same device as the out-of-head localization device 100 shown in FIG. 1. Alternatively, a part or the whole of the measurement device 200 may be a device different from the out-of-head localization device 100.

As shown in FIG. 2, the measurement device 200 includes stereo speakers 5 and stereo microphones 2. The stereo speakers 5 are placed in a measurement environment. The measurement environment is an environment where acoustic characteristics are not taken into consideration (for example, the shape of a room is asymmetric etc.) or an environment where environmental sounds, which are noise, are heard. To be more specific, the measurement environment may be the user U's room at home, a dealer or showroom of an audio system or the like. In such a measurement environment, there is a case where background noise is occurring due to an air conditioner or the like. There is also a case where sudden noise occurs due to vehicle traffic or the like. Further, there is a case where the measurement environment has a layout where acoustic characteristics are not taken into consideration. In a room at home, there is a case where furniture and the like are arranged asymmetrically. There is also a case where speakers are not arranged symmetrically with respect to a room. Further, there is a case where unwanted echoes occur due to reflections off a window, a wall surface, a floor surface and a ceiling surface. In this embodiment, processing is performed for measuring appropriate transfer characteristics even under the measurement environment which is not ideal.

The stereo speakers 5 include a left speaker 5L and a right speaker 5R. For example, the left speaker 5L and the right speaker 5R are placed in front of a listener 1. The left speaker 5L and the right speaker 5R output impulse sounds for impulse response measurement and the like.

The stereo microphones 2 include a left microphone 2L and a right microphone 2R. The left microphone 2L is placed on a left ear 9L of the listener 1, and the right microphone 2R is placed on a right ear 9R of the listener 1. To be specific, the microphones 2L and 2R are preferably placed at the entrance of the ear canal or at the eardrum of the left ear 9L and the right ear 9R, respectively. The microphones 2L and 2R pick up signals that are output from the stereo speakers 5. The listener 1 may be a person or a dummy head. In other words, in this embodiment, the listener 1 is a concept that includes not only a person but also a dummy head.

As a result that the impulse sounds that are output from the left and right speakers 5L and 5R are respectively measured by the microphones 2L and 2R, impulse responses are measured. The transfer characteristics Hls between the left speaker 5L and the left microphone 2L, the transfer characteristics Hlo between the left speaker 5L and the right microphone 2R, the transfer characteristics Hro between the right speaker 5R and the left microphone 2L, and the transfer characteristics Hrs between the right speaker 5R and the right microphone 2R are thereby measured.

The measurement device 200 measures the transfer characteristics Hls to Hrs based on the impulse response measurement. As shown in FIG. 1, the out-of-head localization device 100 performs out-of-head localization by using the transfer characteristics between the left and right speakers 5L and 5R and the left and right microphones 2L and 2R. Specifically, the out-of-head localization is performed by convolving the transfer characteristics to the music reproduction signals.

The control structure of the measurement device 200 is described hereinafter with reference to FIG. 3. The measurement device 200 includes microphones 2L and 2R, amplifiers 3L and 3R, A/D converters 4L and 4R, speakers 5L and 5R, amplifiers 6L and 6R, D/A converters 7L and 7R, a measurement unit 30, a display unit 60, an input unit 70, a storage unit 80, and an operation unit 90.

The display unit 60 includes a display device such as a liquid crystal monitor. The display unit 60 displays a settings screen for measuring transfer characteristics and the like. Further, the display unit 60 displays measurement results, errors during measurement and the like according to need.

The input unit 70 includes an input device such as a touch panel, a button, a keyboard and a mouse, and it receives input from the listener 1. To be specific, the input unit 70 receives input on the settings screen for measuring transfer characteristics.

The operation unit 90 is a control unit that controls the display unit 60 and the input unit 70. Specifically, the operation unit 90 outputs a display signal to the display unit 60. Further, the operation unit 90 outputs, to the measurement unit 30, an input signal in accordance with the input received by the input unit 70.

The storage unit 80 includes a storage device such as a memory or hard disk, and it stores transfer characteristics and various initial values. Further, the storage unit 80 stores settings for measurement and the like. For example, the storage unit 80 stores a specified number of times, a specified value, a threshold and the like, which are described later.

Further, as described later, the storage unit 80 stores transfer characteristics for low frequency correction.

The measurement unit 30 performs control for carrying out various types of measurement. The measurement unit 30 generates signals to be output to the speakers 5L and 5R. Further, the measurement unit 30 performs processing on sound pickup signals from the microphones 2L and 2R.

To be specific, the measurement unit 30 carries out test measurement and transfer characteristics measurement. In the test measurement, the speakers 5L and 5R output environmental measurement signals. The environmental measurement signals output from the speakers 5L and 5R are picked up by the microphones 2L and 2R (first environmental measurement). The measurement unit 30 generates transfer characteristics measurement signals based on measurement results in the test measurement. To be specific, the measurement unit 30 sets the output amplitude levels of the transfer characteristics measurement signals, the tap length, and the parameter of a low frequency threshold based on measurement results in the environmental measurement.

In the transfer characteristics measurement, the speakers 5L and 5R output the transfer characteristics measurement signals. Then, the transfer characteristics measurement signals output from the speakers 5L and 5R are picked up by the microphones 2L and 2R. The measurement unit 30 measures transfer characteristics based on the sound pickup signals. Note that the measurement by the measurement unit 30 is described later.

The measurement unit 30 outputs the environmental measurement signals or the transfer characteristics measurement signals (which are collectively referred to hereinafter as measurement signals) to the D/A converters 7L and 7R. The D/A converters 7L and 7R convert the measurement signals from digital to analog, and output them to the amplifiers 6L and 6R, respectively. The amplifiers 6L and 6R amplify the measurement signals and output them to the speakers 5L and 5R, respectively. The speakers 5L and 5R then output the measurement signals.

Further, the microphones 2L and 2R pick up the measurement signals output from the speakers 5L and 5R, respectively. The microphones 2L and 2R output sound pickup signals in accordance with the picked-up measurement signals to the amplifiers 3L and 3R, respectively. The amplifiers 3L and 3R amplify the sound pickup signals and output them to the A/D converters 4L and 4R, respectively. The A/D converters 4L and 4R convert the sound pickup signals from analog to digital, and output them to the measurement unit 30, respectively. The measurement unit 30 performs digital processing on the A/D converted sound pickup signals.

In the case where measurement is carried out in an environment, other than a measurement room, with much background noise or in a room with no consideration of acoustic characteristics, unwanted background noise comes into the low frequency range, or effects of unwanted reflected sounds or echoes caused by a room enter into the transfer function in some cases. In this case, the accuracy of measurement is degraded. To avoid this, a correction process that reduces unwanted background noise, reflected sounds and effects due to echoes is performed by carrying out environmental measurement before measuring the transfer function. By this correction process, it is possible to obtain the highly accurate transfer function even when measurement is done in any room.

Figure 4:
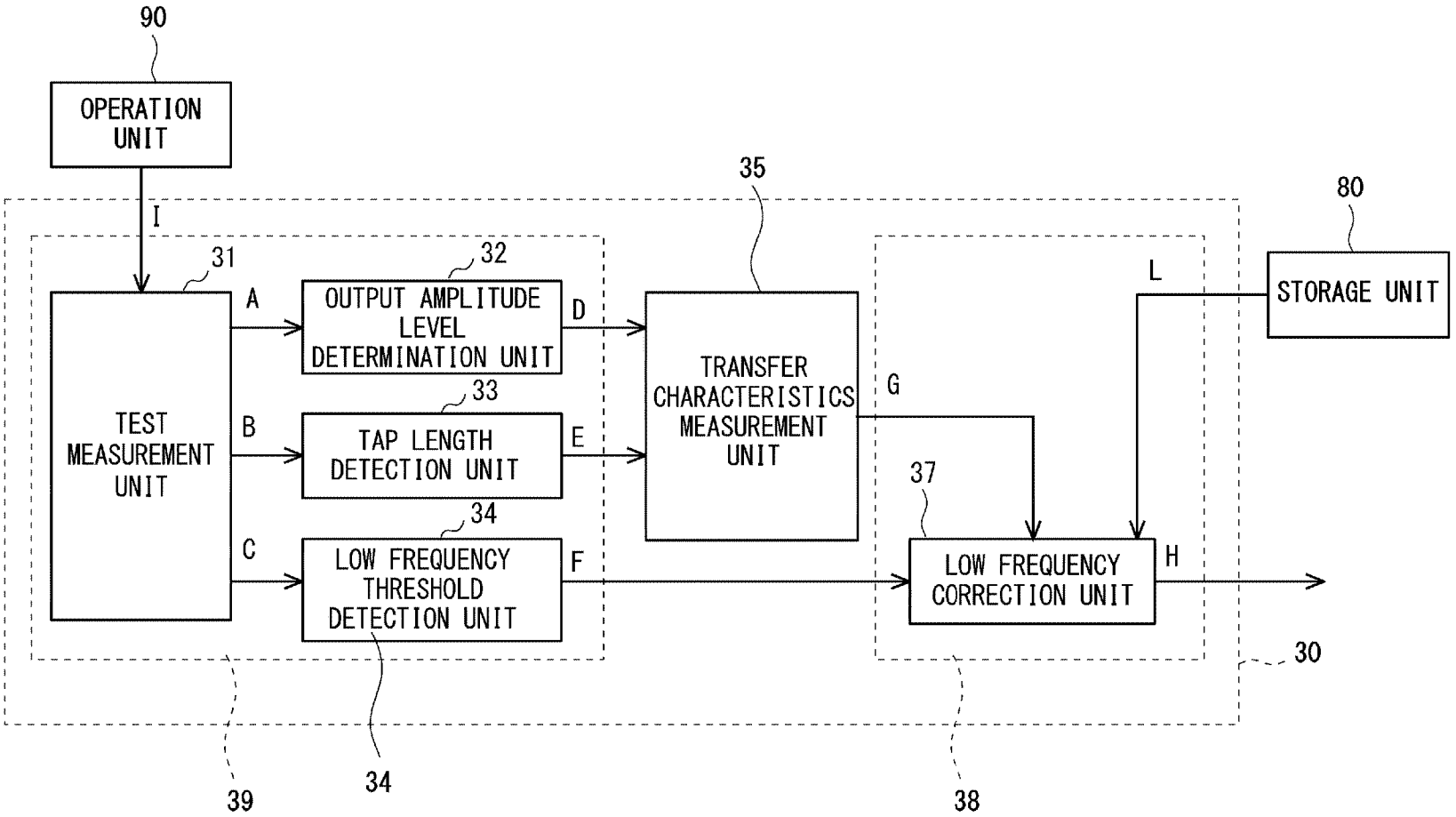
FIG. 4 is a control block diagram showing the detailed structure of a measurement unit.
Figure 5:
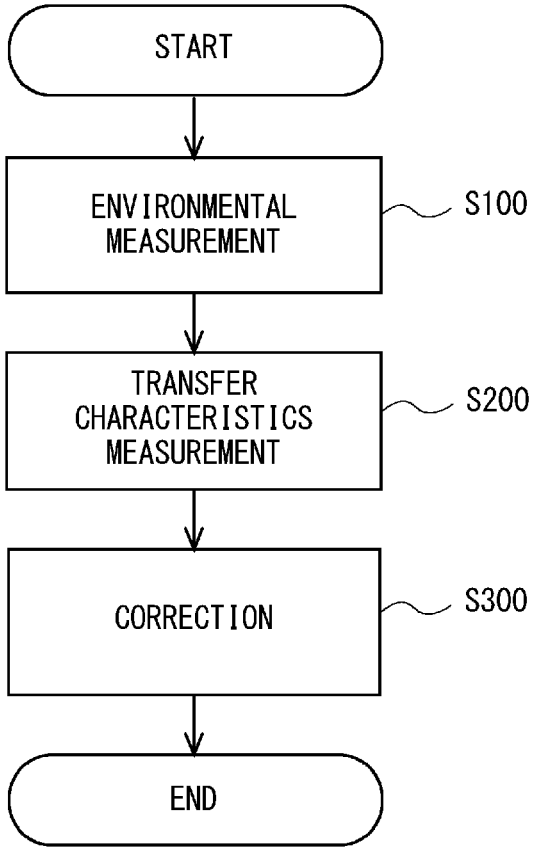
FIG. 5 is a flowchart showing a measurement process.

Measurement by the measurement unit 30 is described in detail hereinafter with reference to FIGS. 4 and 5. FIG. 4 is a control block diagram showing the structure of the measurement unit 30. FIG. 5 is a flowchart showing a measurement process in the measurement unit 30.

The measurement unit 30 includes an environmental measurement unit 39, a transfer characteristics measurement unit 35, and a correction unit 38. The environmental measurement unit 39 includes a test measurement unit 31 that generates and outputs an environmental measurement signal, an output amplitude level determination unit 32 that determines each parameter from acquired transfer characteristics, a tap length detection unit 33, and a low frequency threshold detection unit 34. The correction unit 38 includes a low frequency correction unit 37.

First, the environmental measurement unit 39 performs environmental measurement (S100). The environmental measurement is carried out to generate transfer characteristics measurement signals by the optimum measurement tap length which is as short as possible so as not to be affected by background noise, unwanted reflections or the like. In this step, the environmental measurement signals that are output from the left and right speakers 5L and 5R are picked up by the left and right microphones 2L and 2R, thereby carrying out the environmental measurement.

Then, the transfer characteristics measurement unit 35 performs transfer characteristics measurement (S200). The transfer characteristics measurement signals that are set based on the measurement results in Step S100 are output from the left and right speakers 5L and 5R. The transfer characteristics measurement signals are then picked up by the left and right microphones 2L and 2R, thereby measuring each transfer characteristics (first transfer characteristics) from the left and right speakers 5L and 5R to the left and right microphones 2L and 2R.

The correction unit 38 performs correction processing on the transfer characteristics (S300). Specifically, the transfer characteristics measured in Step S200 are corrected.

(Environmental Measurement)

Figure 6:
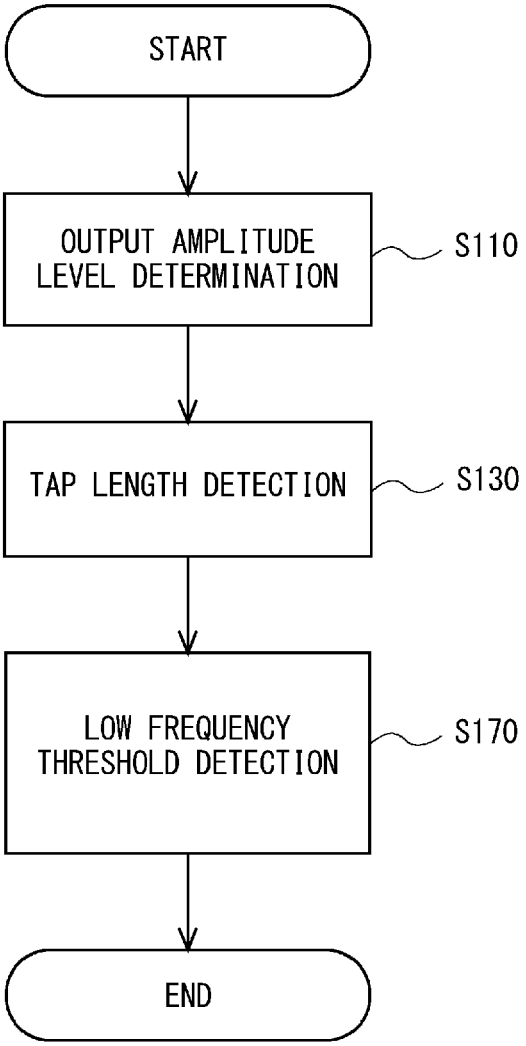
FIG. 6 is a flowchart showing a process of environmental measurement.

The environmental measurement in Step S100 is described with reference to FIG. 6. FIG. 6 is a flowchart showing a process of the environmental measurement. The output amplitude level determination unit 32 performs output amplitude level determination (S110). In this output amplitude level determination, the output amplitude levels of the transfer characteristics measurement signals that are output from the speakers 5L and 5R can be set. The output amplitude level determination unit 32 determines the output amplitude level which is most suitable for the measurement environment. For example, the output gains of the amplifiers 6L and 6R during transfer characteristics measurement are set based on the output amplitude level determined by the output amplitude level determination unit 32. It is thereby possible to generate the transfer characteristics measurement signals with the output amplitude level which is suitable for the measurement environment.

Next, the tap length detection unit 33 performs tap length detection (S130). In the tap length detection, the tap length, i.e., the number of measurement samples, of sound pickup signals picked up by the left microphone 2L and the right microphone 2R are set. As the tap length is longer, the transfer characteristics in a low frequency range can be measured more accurately; however, the measurement time and the processing time are longer and therefore the processing load is greater. Thus, the tap length detection unit 33 detects the tap length which is most appropriate for the measurement environment.

Then, the low frequency threshold detection unit 34 performs low frequency threshold detection (S170). The low frequency threshold detection unit 34 makes corrections in a low frequency range by detecting the threshold of a frequency and, for the frequency range below the threshold, replacing the characteristics with the frequency characteristics of arbitrary transfer characteristics prepared in advance in low frequency correction, which is described later. The low frequency threshold is the threshold of a frequency for dividing the measured transfer characteristics into a correction range where correction is required and a non-correction range where correction is not required.

(Output Amplitude Level Determination)

Figure 7:
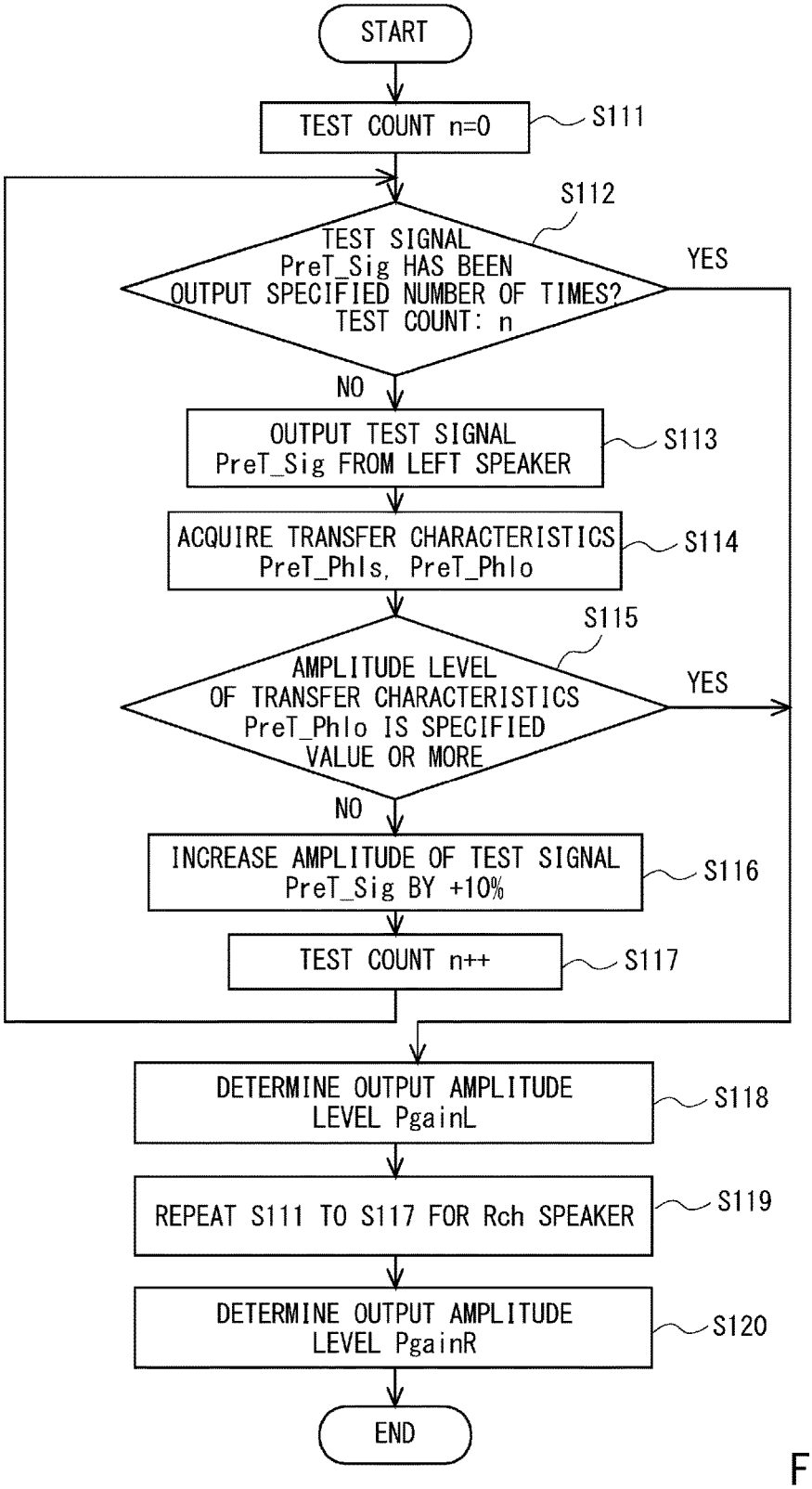
FIG. 7 is a flowchart showing a detailed process of output amplitude level determination.

The output amplitude level determination in Step S110 is described hereinafter with reference to FIG. 7. FIG. 7 is a flowchart showing an output amplitude level determination process. In FIG. 7, processing when the environmental measurement signal PreT_Sig is output from the left speaker 5L is mainly described, and the description of processing related to the right speaker 5R is omitted as appropriate. The processing in FIG. 7 is performed mainly by the test measurement unit 31 and the output amplitude level determination unit 32. The test measurement unit 31 generates a plurality of types of environmental measurement signals in accordance with actual test measurement and outputs them to the speakers 5L and 5R.

First, the test measurement unit 31 receives a measurement start request (I in FIG. 4) of a listener 1 from the operation unit 90, and sets a test count n=0 (S111). n is an integer indicating the number of times a test has been carried out. Next, the test measurement unit 31 determines whether an environmental measurement signal PreT_Sig has been output a specified number of times or not (S112). Specifically, it determines whether n has reached a specified number of times (for example, 10 times). Because n=0 in this example, the test measurement unit 31 determines that the signal has not been output a specified number of times (No in S112). Then, the test measurement unit 31 causes the environmental measurement signal PreT_Sig to be output from the left speaker 5L. The environmental measurement signal PreT_Sig is an impulse sound with a sufficiently small amplitude, for example. To be specific, the amplitude of the environmental measurement signal PreT_Sig can be about 10% of the maximum amplitude level of the environmental measurement signal.

Then, the test measurement unit 31 acquires transfer characteristics PreT_Phls and PreT_Phlo from the left speaker 5L to the left and right microphones 2L and 2R, respectively based on sound pickup signals by the left and right microphones 2L and 2R (S114). Note that the transfer characteristics PreT_Phls and PreT_Phlo respectively correspond to spatial transfer characteristics Hls and Hlo shown in FIG. 2 when the environmental measurement signal PreT_Sig is output. Specifically, the transfer characteristics PreT_Phls is transfer characteristics between the left speaker 5L and the left microphone 2L, and the transfer characteristics PreT_Phlo is transfer characteristics between the left speaker 5L and the right microphone 2R. The test measurement unit 31 outputs the transfer characteristics PreT_Phls and PreT_Phlo to the output amplitude level determination unit 32 (A in FIG. 4).

The output amplitude level determination unit 32 determines whether the amplitude level of the transfer characteristics PreT_Phlo measured by the right microphone 2R is equal to or greater than a specified value (S115). When the amplitude level of the transfer characteristics PreT_Phlo is not equal to or greater than a specified value (No in S115), the test measurement unit 31 increases the output amplitude level of the environmental measurement signal PreT_Sig by +10% (S116). Specifically, when the amplitude level of the transfer characteristics PreT_Phlo does not reach a specified value, the test measurement unit 31 increases the amplitude of the environmental measurement signal PreT_Sig by +10%. Then, the test measurement unit 31 increments n (adds 1 to n) (S117), and returns to Step S112.

After that, the test measurement unit 31 repeats the processing from Step S112 to S117 until the determination in S112 or S115 results in Yes. Specifically, the test measurement unit 31 performs the processing of Step S112 to S117 until the environmental measurement signal PreT_Sig is output 10 times, or until the amplitude level of the transfer characteristics PreT_Phlo becomes equal to or greater than a specified value. In this way, test measurement is carried out by increasing the amplitude of the environmental measurement signal PreT_Sig little by little. The test measurement unit 31 increases the amplitude of the environmental measurement signal PreT_Sig until the microphone 2R outputs the sound pickup signal having an appropriate amplitude level.

When the environmental measurement signal PreT_Sig is output a specified number of times (Yes in S112), or when the amplitude level of the transfer characteristics PreT_Phlo becomes equal to or greater than a specified value (Yes in S115), the output amplitude level determination unit 32 determines the output amplitude level PgainL (S118). Specifically, the output amplitude level determination unit 32 determines the output amplitude level during transfer characteristics measurement based on the amplitude level of the transfer characteristics PreT_Phlo. When the amplitude level of the transfer characteristics PreT_Phlo does not become equal to or greater than a specified value within a specified number of times, the output amplitude level determination unit 32 may issue an output amplitude level error and ends the process.

Likewise, the test measurement unit 31 repeats the processing from Step S111 to S117 for the right speaker 5R (S119). The output amplitude level determination unit 32 determines the output amplitude level PgainR in the right speaker 5R (S120). Specifically, the test measurement unit 31 measures the transfer characteristics PreT_Phrs between the right speaker 5R and the right microphone 2R and the transfer characteristics PreT_Phro between the right speaker 5R and the left microphone 2L. Based on the measurement results, the output amplitude level determination unit 32 determines the output amplitude level PgainR. The output amplitude level PgainR of the transfer characteristics measurement signal that is output from the right speaker 5R is thereby determined.

The measurement of the output amplitude levels thereby ends. Then, the output amplitude level determination unit 32 outputs the output amplitude levels PgainL and PgainR to the transfer characteristics measurement unit 35 (D in FIG. 4). It is thereby possible to perform the transfer characteristics measurement with appropriate output amplitude levels.

(Tap Length Detection)

Figure 8:
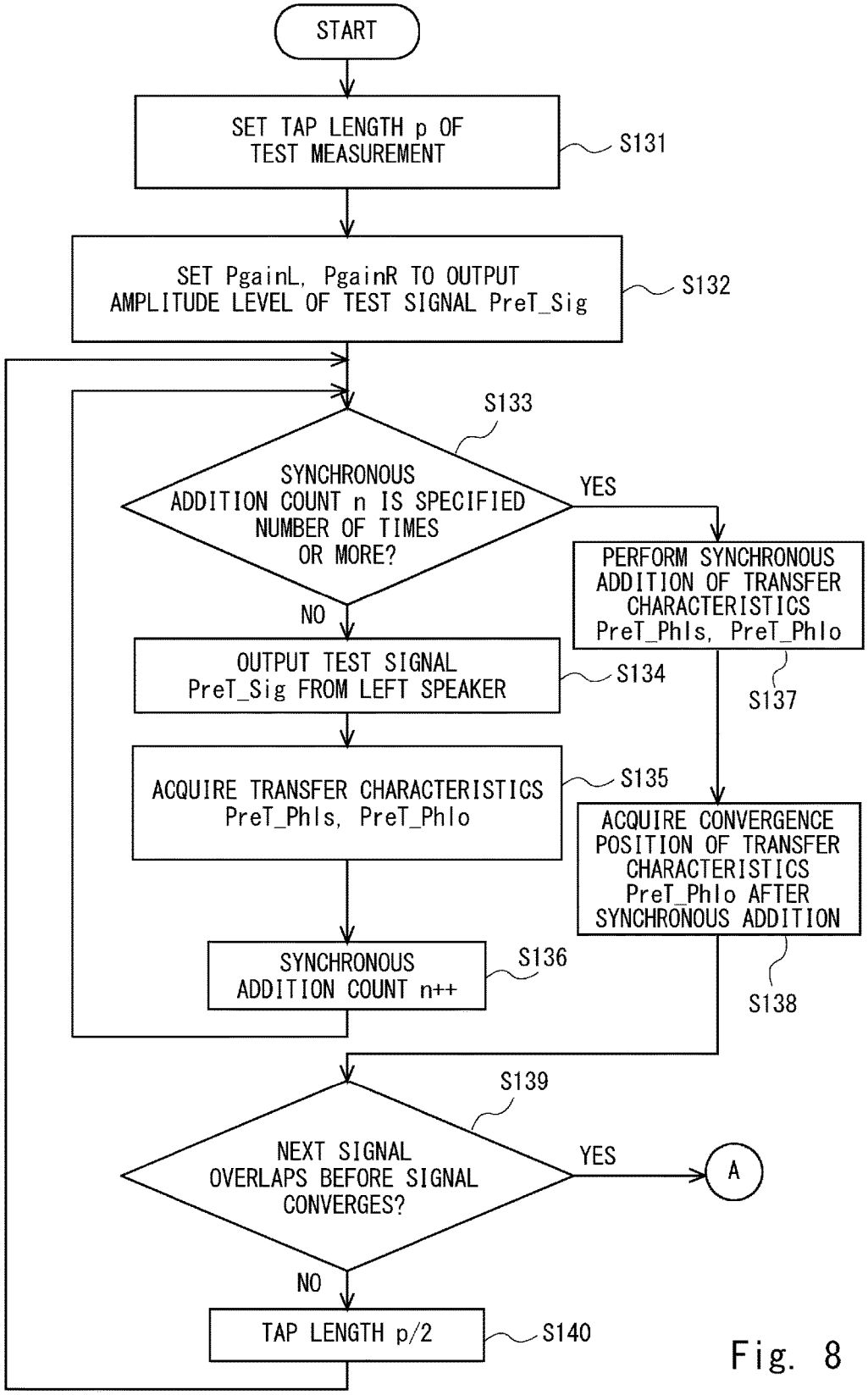
FIG. 8 is a flowchart showing a detailed process of tap length detection.
Figure 9:
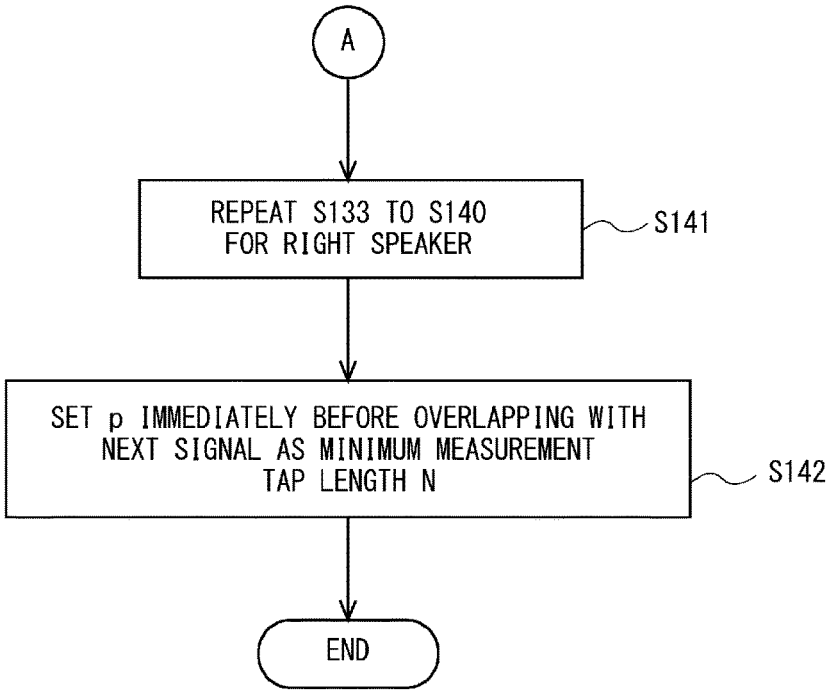
FIG. 9 is a flowchart showing a detailed process of tap length detection.

The tap length detection in Step S130 is described hereinafter in detail with reference to FIGS. 8 and 9. FIGS. 8 and 9 are flowcharts showing the tap length detection in Step S130. Each processing shown in FIGS. 8 and 9 is performed mainly by the test measurement unit 31 or the tap length detection unit 33. When the tap length is longer, the transfer characteristics in a low frequency range can be calculated more accurately. However, the processing load becomes greater since the measurement time is longer, and it is necessary to set a tap length suitable for an environment because unwanted echoes or reflected sounds can be picked up. Thus, the processing using the shortest possible measurement tap length in order to minimize the effects of unwanted reflected sounds and echoes is described.

First, the test measurement unit 31 sets a tap length p (p is an integer, which is preferably a power of 2) of test measurement (S131). In this step, the tap length p is set to be long enough. Thus, a sufficiently long initial set value is set. For example, the tap length p is set to the maximum measurable tap length. Then, PgainL and PgainR, which are obtained in S110, are set as the output amplitude levels of the environmental measurement signal PreT_Sig (S132). The test measurement can be thereby carried out with appropriate amplitude levels.

Next, the test measurement unit 31 determines whether a synchronous addition count n is equal to or more than a specified number of times (S133). Note that the synchronous addition is to synchronize and add the sound pickup signals acquired by a plurality of impulse response measurements. By performing the synchronous addition, it is possible to reduce the effect of unexpected noise. For example, the specified number of times n of the synchronous addition count n may be 10.

Because the synchronous addition count n is less than a specified number of times (No in S133), the test measurement unit 31 outputs the environmental measurement signal PreT_Sig from the left speaker 5L (S134). By picking up the environmental measurement signal PreT_Sig using the microphones 2L and 2R, the transfer characteristics PreT_Thls and PreT_Thlo are acquired (S135). The transfer characteristics PreT_Thls and PreT_Thlo are preferably stored in the storage unit 80 in association with the tap length p at the time of acquisition.

After acquiring the transfer characteristics PreT_Thls and PreT_Thlo, the synchronous addition count n is incremented (S136). The process then returns to Step S133 and is repeated. Specifically, the processing of Steps S133 to S136 is repeated until the synchronous addition count n reaches a specified number of times. The value of the synchronous addition count n is not limited to 10 as a matter of course.

When the synchronous addition count reaches a specified number of times n (Yes in S133), the transfer characteristics PreT_Thls and PreT_Thlo for a specified number of times are synchronized and added (S137). Specifically, regarding the transfer characteristics PreT_Thls and PreT_Thlo, the signals for a specified number of times are added and averaged. Note that the synchronous addition may be performed at the same time as the acquisition of the transfer characteristics PreT_Thls and PreT_Thlo. Specifically, Step S137 may be performed after Step S135 and before Step S136.

The test measurement unit 31 outputs the transfer characteristics PreT_Thls and PreT_Thlo after synchronous addition to the tap length detection unit 33 (B in FIG. 4). Then, the tap length detection unit 33 acquires the convergence position of the transfer characteristics PreT_Thlo based on the transfer characteristics PreT_Thls and PreT_Thlo after synchronous addition (S138). To be specific, a sample position at which the transfer characteristics PreT_Thlo fall within 5% of the peak is preferably set as the convergence position. In this case, a sample position that comes after the last sample position at which the transfer characteristics PreT_Thlo exceeds 5% of the peak in the tap length p is the convergence position. The proportion for setting the convergence position is not limited to 5%, and it can be set as appropriate.

Then, the tap length detection unit 33 determines whether the next signal overlaps before the signal converges (S139). In this step, impulse response measurement is carried out by outputting an impulse sound two times with a specified time interval. To be specific, the impulse sound is output two times from the left speaker 5L by using the tap length p which is equal to or more than the number of samples of the above-described convergence position. For example, a value which is equal to or more than the number at the convergence position and which is the smallest value among the powers of 2 is set as the tap length p. Then, two impulse sounds with a time interval of the tap length p are output from the left speaker 5L. To be specific, when the number at the convergence position is 500 taps, the tap length p=512. The left speaker 5L outputs the impulse sound two times with a time interval of the tap length p=512. The two times of impulse sounds are measured by the microphones 2L and 2R. The tap length detection unit 33 determines whether the sound pickup signal of the first impulse sound overlaps the sound pickup signal of the second impulse sound.

The reason for outputting the impulse sound two times is described hereinafter. If the interval between the convergence of the first impulse sound and the input of the second impulse sound is long enough, the interval between the two impulse sounds can be shorter. On the other hand, when the second impulse sound is output before the first impulse sound converges, the interval between the impulse sounds is too short. Thus, the reason for outputting the impulse sound two times is to obtain the shortest interval between the impulse sounds where the first and second impulse sounds do not overlap. Based on the interval of the impulse sounds obtained in this manner, the shortest tap length can be obtained.

Figure 10:
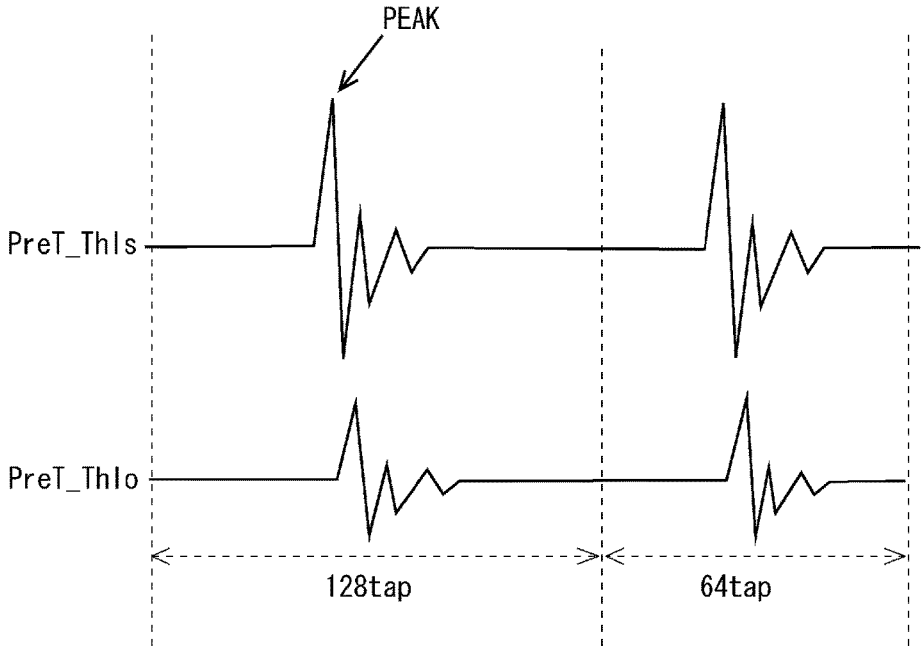
FIG. 10 is a view showing a signal waveform when signals do not overlap.
Figure 11:
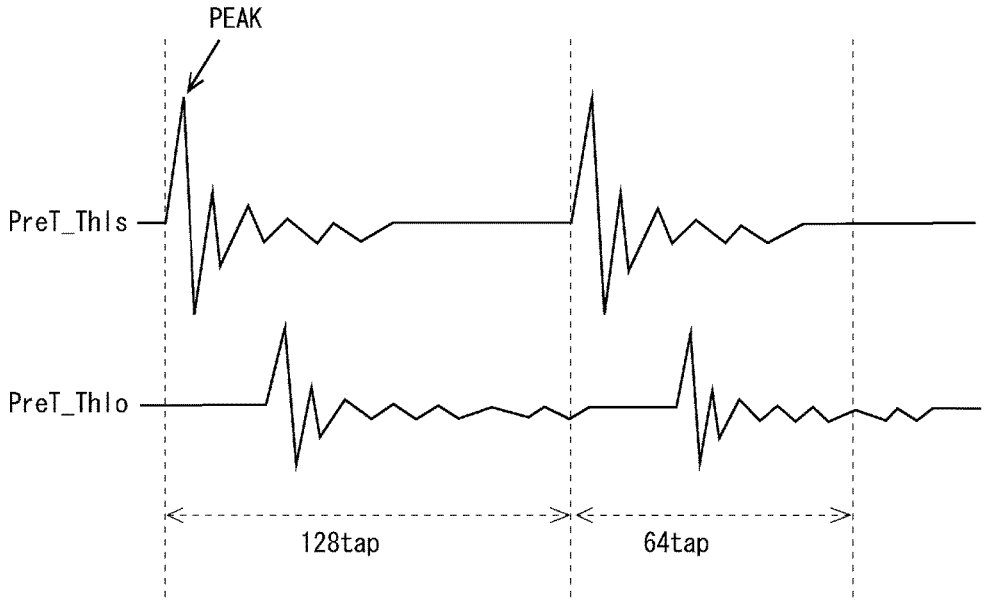
FIG. 11 is a view showing a signal waveform when signals overlap.

FIGS. 10 and 11 show the waveforms of sound pickup signals PreT_Thls and PreT_Thlo when the impulse sound is output two times from the speaker 5L. The upper part shows the sound pickup signal PreT_Thls by the left microphone 2L, and the lower part shows the sound pickup signal PreT_Thlo by the right microphone 2R. FIG. 10 shows the signal waveforms when the sound pickup signals do not overlap, and FIG. 11 shows the signal waveforms when the sound pickup signals overlap. In FIGS. 10 and 11, the impulse sound is generated where the tap length p is 128. Thus, the first and second impulse sounds are generated with a lag of 128 taps.

In FIG. 10, there are less echoes of the sound pickup signal at the right microphone, and the sound pickup signal converges in a short time. Thus, the first and second impulse sounds are measured separately from each other. Accordingly, the tap length detection unit 33 determines that the next signal does not overlap before the first signal converges (No in S139). In this case, there is a possibility that the tap length can be shorter. Thus, when the sound pickup signal of the first impulse sound and the sound pickup signal of the second impulse sound do not overlap (No in S139), the tap length p is set to p/2 (Step S140). After dividing the tap length p by 2, the processing from Step S133 is repeated. In FIG. 10, because the tap length p is 128, Steps S133 to S139 are then performed by setting the tap length p=64. Then, the processing of Steps S133 to S140 is repeated until the signals of the two impulse sounds overlap.

In FIG. 11, there are more echoes contained in the sound pickup signal at the right microphone 2R, and the signal of the left microphone 2L in the second impulse response measurement is input before the signal of the right microphone 2R in the first impulse response measurement converges, and the two signals overlap (Yes in Step S139). When the tap length detection unit 33 determines that the next signal overlaps before the signal converges (Yes in Step S139), the process proceeds to the next step (A in FIG. 8). Specifically, Steps S133 to S140 are repeated for the right speaker 5R (S141).

Whether or not the signals by the first and second impulse sounds overlap can be determined by a correlation between the sound pickup signal by the first impulse sound and the sound pickup signal by the second impulse sound. For example, the sound pickup signal is cut out by the tap length p, thereby dividing the signal into a response of the first impulse sound and a response of the second impulse sound. Then, the response of the first impulse sound and the response of the second impulse sound are compared to obtain a correlation. When there is a high correlation, the tap length detection unit 33 determines that the impulse sounds are separated, which are, the signals do not overlap. When, on the other hand, there is a low correlation, the tap length detection unit 33 determines that the impulse sounds are not separated, which are, the signals overlap.

It is thereby possible to obtain the tap length p for each of the left and right speakers 5L and 5R. Then, the tap p immediately before overlapping with the next signal is set as the minimum measurement tap length N (S142). The measurement tap length N is a natural number of 1 or more, and it is preferably a power of 2. For example, when the tap length that overlaps the next signal is 64, the measurement tap length N is preferably 128 (64×2). When the measurement tap length N is different between the left and right speakers 5L and 5R, the longer measurement tap length N is preferably set as a common tap length N. Then, the tap length detection unit 33 outputs the measurement tap length N to the transfer characteristics measurement unit 35 (E in FIG. 4). It is thereby possible for the transfer characteristics measurement unit 35 to measure the transfer characteristics with the appropriate measurement tap length N.

(Low Frequency Threshold Detection)

Figure 12:
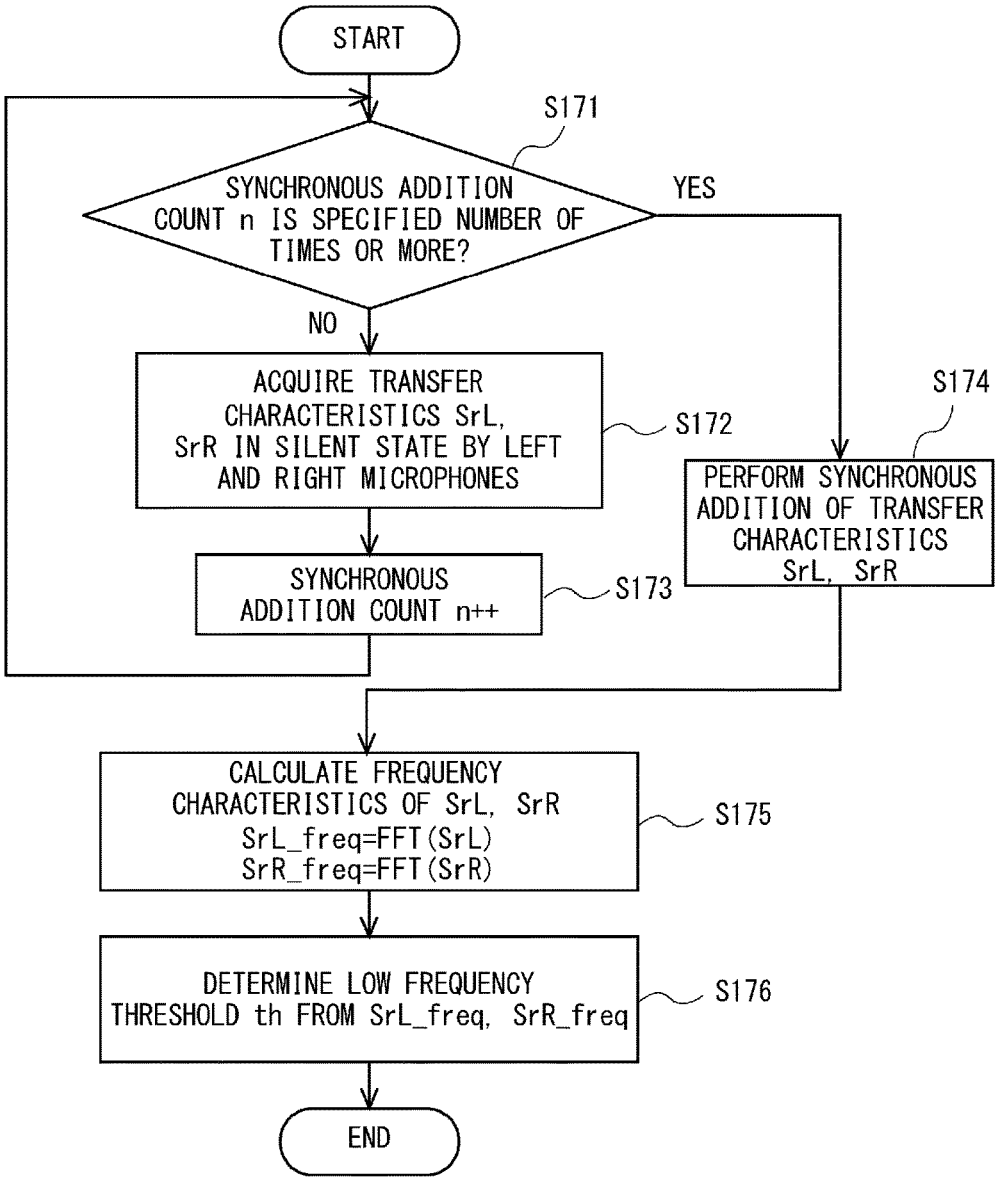
FIG. 12 is a flowchart showing a low frequency threshold detection process.

The low frequency threshold detection in Step S170 is described hereinafter in detail with reference to FIG. 12. FIG. 12 is a flowchart showing the low frequency threshold detection process. Each processing shown in FIG. 12 is performed mainly by the test measurement unit 31 and the low frequency threshold detection unit 34.

First, it is determined whether the synchronous addition count n is equal to or more than a specified number of times (S171). Because the synchronous addition count n is less than a specified number of times (No in S171), the test measurement unit 31 acquires the transfer characteristics (second transfer characteristics) SrL and SrR in a silent state by the left and right microphones 2L and 2R (second environmental measurement) (S172). The silent state is the state where no sound is output from the speakers 5L and 5R. Thus, the second environmental measurement is performed in the silent state. In other words, the microphones 2L and 2R pick up the background noise occurring from a source other than the speakers 5L and 5R in the measurement environment.

Then, the test measurement unit 31 increments the synchronous addition count n (S173), and returns to Step S171. After that, the test measurement unit 31 repeats Steps S171 to S173 until the synchronous addition count n becomes equal to or more than a specified number of times. The characteristics SrL and SrR in the silent state where no sound is output from the speakers 5L and 5R are measured for a specified number of times. For example, the specified number of times n of the synchronous addition count can be 10.

When the synchronous addition count n becomes equal to or more than a specified number of times (Yes in S171), each of the characteristics SrL and SrR is synchronized and added (S174). Note that the synchronous addition may be performed at the same time as the acquisition of the transfer characteristics PreT_Thls and PreT_Thlo. Specifically, Step S174 may be performed after Step S171 and before Step S172. Then, the low frequency threshold detection unit 34 calculates the frequency characteristics SrL_freq and SrR_freq of the characteristics SrL and SrR after synchronous addition (S175). To be specific, the test measurement unit 31 synchronizes and adds the characteristics SrL and SrR, and outputs them to the low frequency threshold detection unit 34 (C in FIG. 4). The low frequency threshold detection unit 34 then performs discrete Fourier transform of the characteristics SrL in the time domain and thereby obtains the frequency characteristics SrL_freq. Likewise, the low frequency threshold detection unit 34 performs discrete Fourier transform of the characteristics SrR in the time domain and thereby obtains the frequency characteristics SrR_freq. In this example, the low frequency threshold detection unit 34 obtains the frequency characteristics SrL_freq and SrR_freq by FFT (fast Fourier transform). The transformation to the frequency domain may be done using discrete cosine transform or the like, not limited to fast Fourier transform (discrete Fourier transform).

Figure 13:
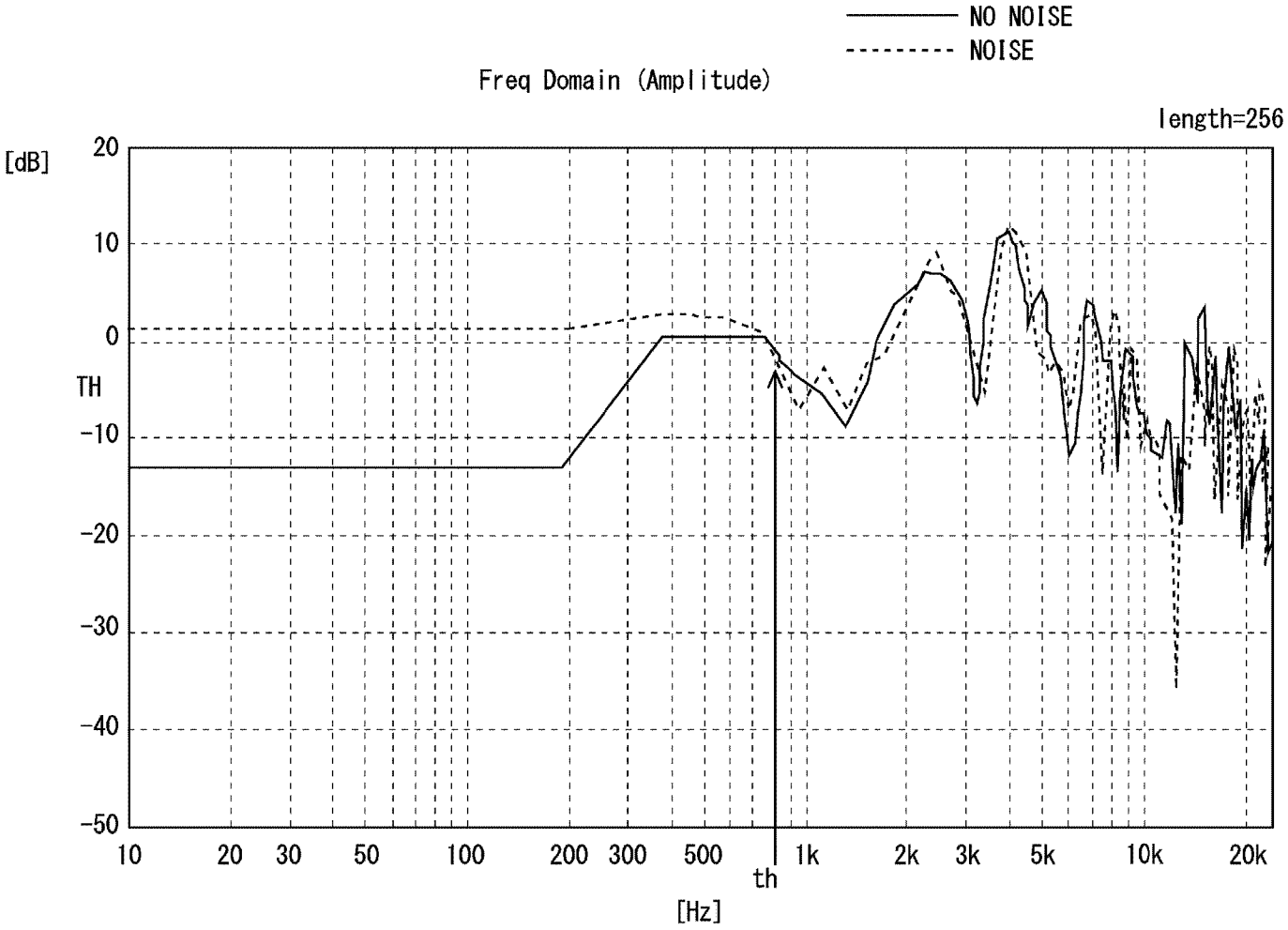
FIG. 13 is a view showing a difference in frequency characteristics depending on the presence or absence of noise.

Then, the low frequency threshold detection unit 34 determines a low frequency threshold th from the frequency characteristics SrL_freq and SrR_freq in the silent state (S176). The low frequency threshold th may be different thresholds or the same threshold between the L channel and the R channel. A difference in the characteristics depending on the presence or absence of noise is described hereinafter with reference to FIG. 13. FIG. 13 is a graph showing the frequency characteristics, where the horizontal axis is a frequency (Hz) and the vertical axis is an amplitude (dB). In FIG. 13, the solid line indicates the frequency characteristics measured in a measurement environment with no noise, and the dotted line indicates the frequency characteristics measured in a measurement environment with noise. "No noise" is an example of data measured in a laboratory with less background noise, where reflections and echoes are acoustically taken into consideration. "Noise" is an example of data measured in a room with background noise and speaking voice, where reflections and echoes are not acoustically taken into consideration. FIG. 13 shows the frequency characteristics measured at the same speaker and the same listener 1.

As shown in FIG. 13, the frequency characteristics differ significantly in a low frequency range of 800 Hz or less depending on the presence or absence of noise. Specifically, when there is noise, the amplitude in the low frequency range is greater than that when there is no noise. This is because noise in a low frequency range (low frequency band) occurs due to a compressor of an air conditioner or the like, which affects the measurement environment. In this manner, background noise is likely to occur at all times in a low frequency range. Therefore, in an actual measurement environment, it is difficult to accurately measure the frequency characteristics in a low frequency range. On the other hand, the amplitude does not differ largely depending on the presence or absence of noise in a high frequency range of 3 kHz or more.

Thus, in this embodiment, the transfer characteristics are corrected in accordance with the determined low frequency threshold th. To be specific, in a low frequency range (low frequency band) which is equal to or lower than the low frequency threshold th, the transfer characteristics are corrected by the frequency characteristics stored in advance. On the other hand, in a high frequency range (high frequency band) which is higher than the low frequency threshold th, the amplitude value (filter value) of the frequency characteristics obtained in the transfer characteristics measurement by the transfer characteristics measurement unit 35 is used without any modification.

To be specific, the highest frequency in the frequency range of noise is set as the low frequency threshold th. For example, a frequency that is below a threshold (e.g., 800 Hz) is set as the low frequency threshold th. Specifically, the low frequency threshold th is set by comparing the frequency characteristics SrL_freq and SrR_freq in the silent state with a threshold. A frequency at which the amplitude level of the frequency characteristics SrL_freq, SrR_freq reaches a preset threshold is set as the low frequency threshold th. Further, the low frequency threshold detection unit 34 determines the low frequency threshold th for each of the left and right frequency characteristics SrL_freq and SrR_freq. The low frequency threshold detection unit 34 then outputs the left and right low frequency thresholds th to the low frequency correction unit 37 (F in FIG. 4).

The low frequency correction unit 37 corrects a low frequency range of the transfer characteristics based on the low frequency threshold th. The correction by the low frequency correction unit 37 is described later.

(Transfer Characteristics Measurement)

Figure 14:
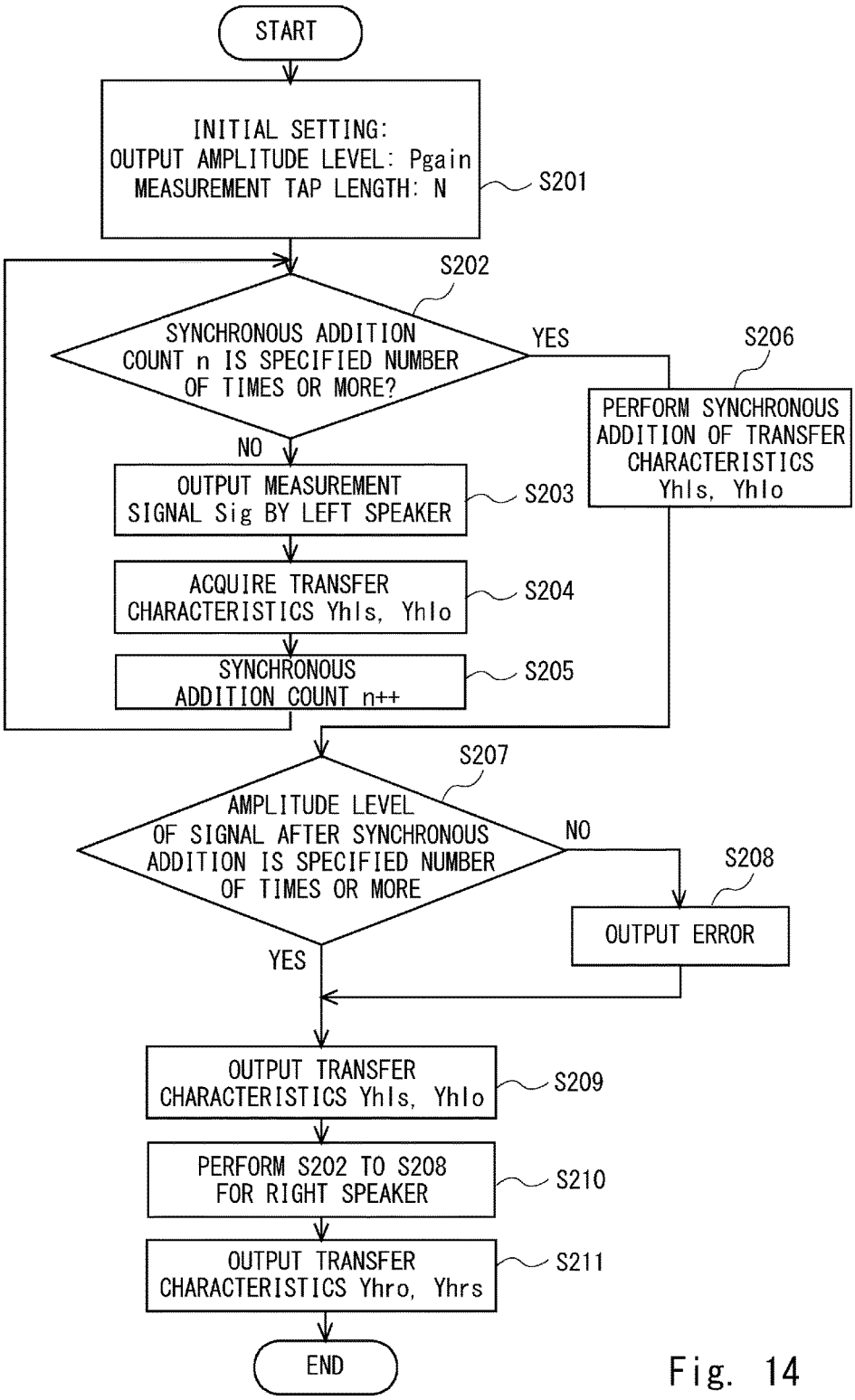
FIG. 14 is a flowchart showing a measurement process of transfer characteristics.

Measurement of the transfer characteristics in the transfer characteristics measurement unit 35 is described hereinafter with reference to FIG. 14. FIG. 14 is a flowchart showing a measurement process of the transfer characteristics. FIG. 14 mainly shows processing on the left speaker 5L.

The transfer characteristics measurement unit 35 measures spatial acoustic transfer characteristics based on the output amplitude levels PgainL and PgainR and the measurement tap length N. First, the transfer characteristics measurement unit 35 initially sets the output amplitude levels PgainL and PgainR and the measurement tap length N determined in Steps S110 and S130 (S201). Next, the transfer characteristics measurement unit 35 determines whether the synchronous addition count n is equal to or more than a specified number of times (S202). Because the synchronous addition count n is less than a specified number of times in this step (No in S202), the left speaker 5L outputs a transfer characteristics measurement signal Sig (S203).

Then, the transfer characteristics measurement unit 35 acquires the characteristics Yhls and Yhlo by the microphones 2L and 2R, respectively (S204), increments the synchronous addition count n (S205), and returns to Step S202. Specifically, the transfer characteristics measurement unit 35 repeats Steps S202 to S205 until the synchronous addition count n becomes equal to or more than a specified number of times.

When the synchronous addition count n becomes equal to or more than a specified number of times (Yes in S202), the transfer characteristics measurement unit 35 synchronizes and adds the transfer characteristics acquired by the microphones 2L and 2R (S206). The transfer characteristics measurement unit 35 then determines whether the amplitude level of the signal after synchronous addition is equal to or greater than a specified value (S207). When the amplitude level of the signal after synchronous addition is not equal to or greater than a specified value (No in S207), the display unit 60 produces an error output (S208), and the transfer characteristics measurement unit 35 outputs the transfer characteristics Yhls and Yhlo to the correction unit 38 (S209). By the error output, the listener 1 can recognize that the accuracy of measurement is low. When the error output is produced, the transfer characteristics measurement unit 35 may change the setting of the output amplitude level and measure the transfer characteristics again.

When, on the other hand, the amplitude level of the signal after synchronous addition is equal to or greater than a specified value (Yes in S207), the transfer characteristics measurement unit 35 outputs the characteristics Yhls and Yhlo to the correction unit 38 (S209). In other words, the signal after synchronous addition is used as the characteristics Yhls and Yhlo. The characteristics Yhls is the transfer characteristics (spatial acoustic transfer characteristics) from the left speaker 5L to the left microphone 2L, and the characteristics Yhlo is the transfer characteristics (spatial acoustic transfer characteristics) from the left speaker 5L to the right microphone 2R.

After the measurement for the left speaker 5L ends, the transfer characteristics measurement unit 35 performs Steps S202 to S208 for the right speaker 5R also (S210). As a result, the transfer characteristics measurement unit 35 outputs the transfer characteristics Yhro and the transfer characteristics Yhrs to the low frequency correction unit 37 (S211). The characteristics Yhrs is the transfer characteristics (spatial acoustic transfer characteristics) from the right speaker 5R to the right microphone 2R, and the characteristics Yhro is the transfer characteristics (spatial acoustic transfer characteristics) from the right speaker 5R to the left microphone 2L.

The transfer characteristics measurement unit 35 outputs, as the transfer characteristics, the transfer characteristics Yhls, Yhlo, Yhro and Yhrs to the low frequency correction unit 37 (G in FIG. 4). In this manner, the transfer characteristics measurement unit 35 can measure the transfer characteristics with appropriate initial set values. Specifically, it can perform measurement with the appropriate output amplitude level and measurement tap length. It is thereby possible to accurately measure the transfer characteristics.

(Low Frequency Correction)

Figure 15:
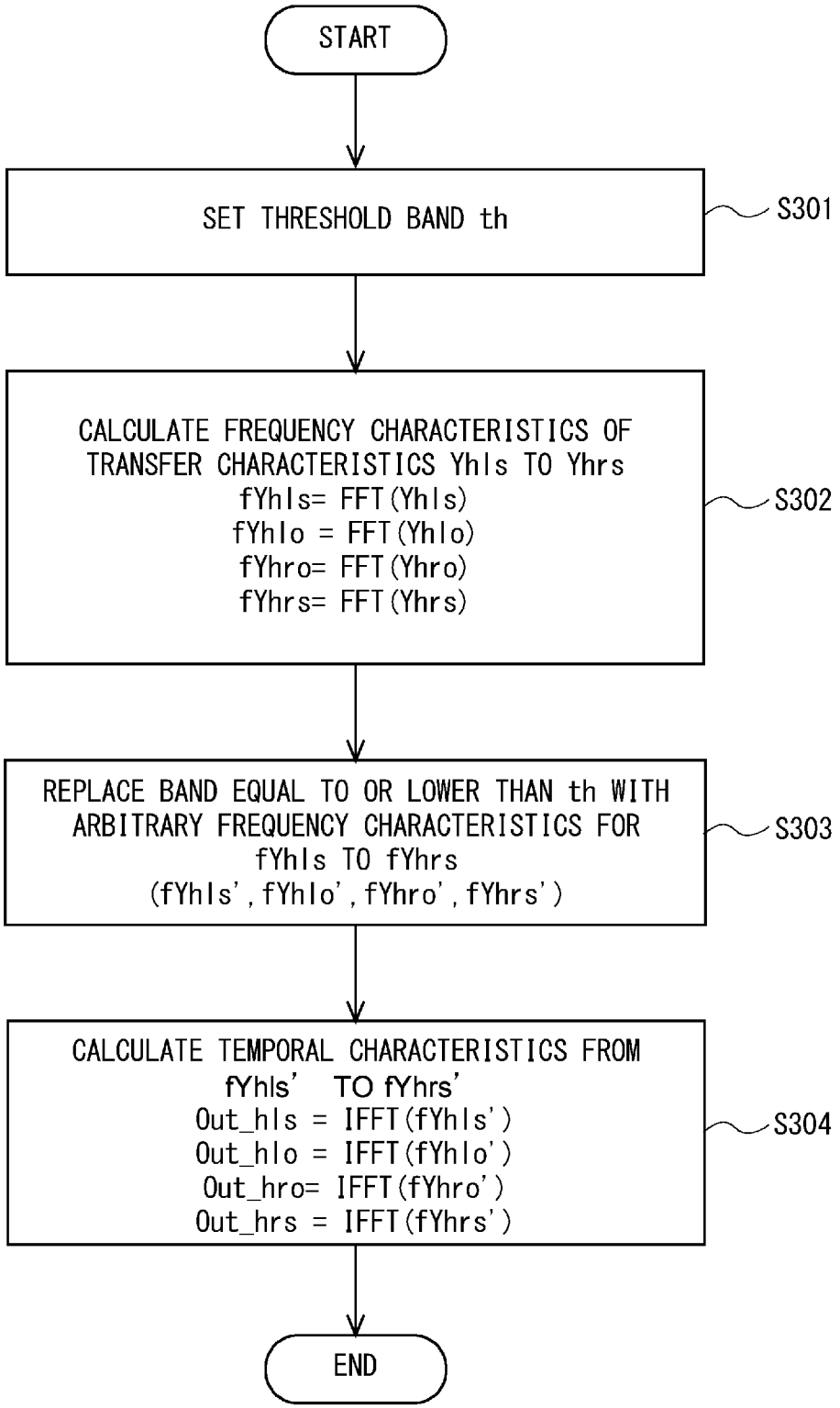
FIG. 15 is a flowchart showing a low frequency correction process.

The correction by the low frequency correction unit 37 is described hereinafter with reference to FIG. 15. FIG. 15 is a flowchart showing the correction process in Step S300. Each processing shown in FIG. 15 is performed mainly by the low frequency correction unit 37.

First, the low frequency correction unit 37 sets a low frequency threshold th (S301). In this example, the low frequency threshold th detected by the low frequency threshold detection unit 34 is used. Next, the low frequency correction unit 37 calculates the frequency characteristics of the transfer characteristics Yhls, Yhlo, Yhro and Yhrs (S302). In this example, the low frequency correction unit 37 performs Fourier transform of the transfer characteristics Yhls, Yhlo, Yhro and Yhrs measured by the transfer characteristics measurement unit 35 in Step S200. The low frequency correction unit 37 thereby calculates the frequency characteristics. Note that the frequency characteristics of the transfer characteristics Yhls, Yhlo, Yhro and Yhrs are referred to as fYhls, fYhlo, fYhro and fYhrs, respectively. In this example, the frequency characteristics fYhls, fYhlo, fYhro and fYhrs are calculated by FFT (Fourier transform) of the transfer characteristics Yhls, Yhlo, Yhro and Yhrs, respectively. Further, the phase characteristics are also calculated by Fourier transform.

Then, the low frequency correction unit 37 replaces the frequency range equal to or less than the low frequency threshold th with arbitrary frequency characteristics (S303). The arbitrary frequency characteristics are previously stored in the storage unit 80. The low frequency correction unit 37 reads the frequency characteristics of the low frequency correction transfer characteristics that are previously stored in the storage unit 80 (L in FIG. 4), and corrects the frequency characteristics fYhls, fYhlo, fYhro and fYhrs. The low frequency correction unit 37 corrects only the frequency range that is equal to or less than the low frequency threshold th of the frequency characteristics fYhls, fYhlo, fYhro and fYhrs.

For example, when the low frequency threshold th is 800 Hz, the frequency characteristics equal to or less than 800 Hz of the above-described fYhls are replaced with arbitrary frequency characteristics that are stored previously. As the frequency characteristics previously stored in the storage unit 80, the frequency characteristics that have been measured in a measurement environment with no noise can be used. Further, the frequency characteristics that have been measured in a third person different from the listener 1, or a dummy head, may be used. Furthermore, the most appropriate frequency characteristics may be selected by the listener 1 from among a plurality of preset frequency characteristics. The frequency characteristics obtained by replacing the frequency characteristics in the low frequency range of the frequency characteristics fYhls, fYhlo, fYhro and fYhrs are referred to as fYhls', fYhlo', fYhro' and fYhrs', respectively. In other words, the frequency characteristics Yhls', fYhlo', fYhro' and fYhrs' are the frequency characteristics after correction.

After that, the low frequency correction unit 37 calculates the temporal characteristics from the frequency characteristics fYhls', fYhlo', fYhro' and fYhrs' after correction (S304). The temporal characteristics calculated from the frequency characteristics fYhls', fYhlo', fYhro' and fYhrs' are respectively referred to as Out_hls, Out_hlo, Out_hro and Out_hrs. For example, the low frequency correction unit 37 performs inverse fast Fourier transform (IFFT) and thereby calculates the temporal characteristics Out_hls, Out_hlo, Out_hro and Out_hrs. In this manner, as the amplitude characteristics to be used for inverse Fourier transform, the frequency characteristics fYhls', fYhlo', fYhro' and fYhrs' where the frequency characteristics in the low frequency range have been corrected are used. Further, as the phase characteristics to be used for inverse Fourier transform, the measured frequency characteristics may be used without any modification or with some modification.

The low frequency correction unit 37 outputs, as the transfer characteristics, the calculated temporal characteristics to the out-of-head localization unit 10 (H in FIG. 4). Then, during out-of-head localization, the out-of-head localization unit 10 carries out convolution to reproduction signals by using the transfer characteristics Out_hls, Out_hlo, Out_hro and Out_hrs. Specifically, the temporal characteristics Out_hls, Out_hlo, Out_hro and Out_hrs are used respectively as the transfer characteristics Hls, Hlo, Hro and Hrs shown in FIG. 1. The temporal characteristics Out_hls, Out_hlo, Out_hro and Out_hrs are convolved to stereo input signals. It is thereby possible to perform out-of-head localization with use of appropriate transfer characteristics.

Second Embodiment

Figure 16:
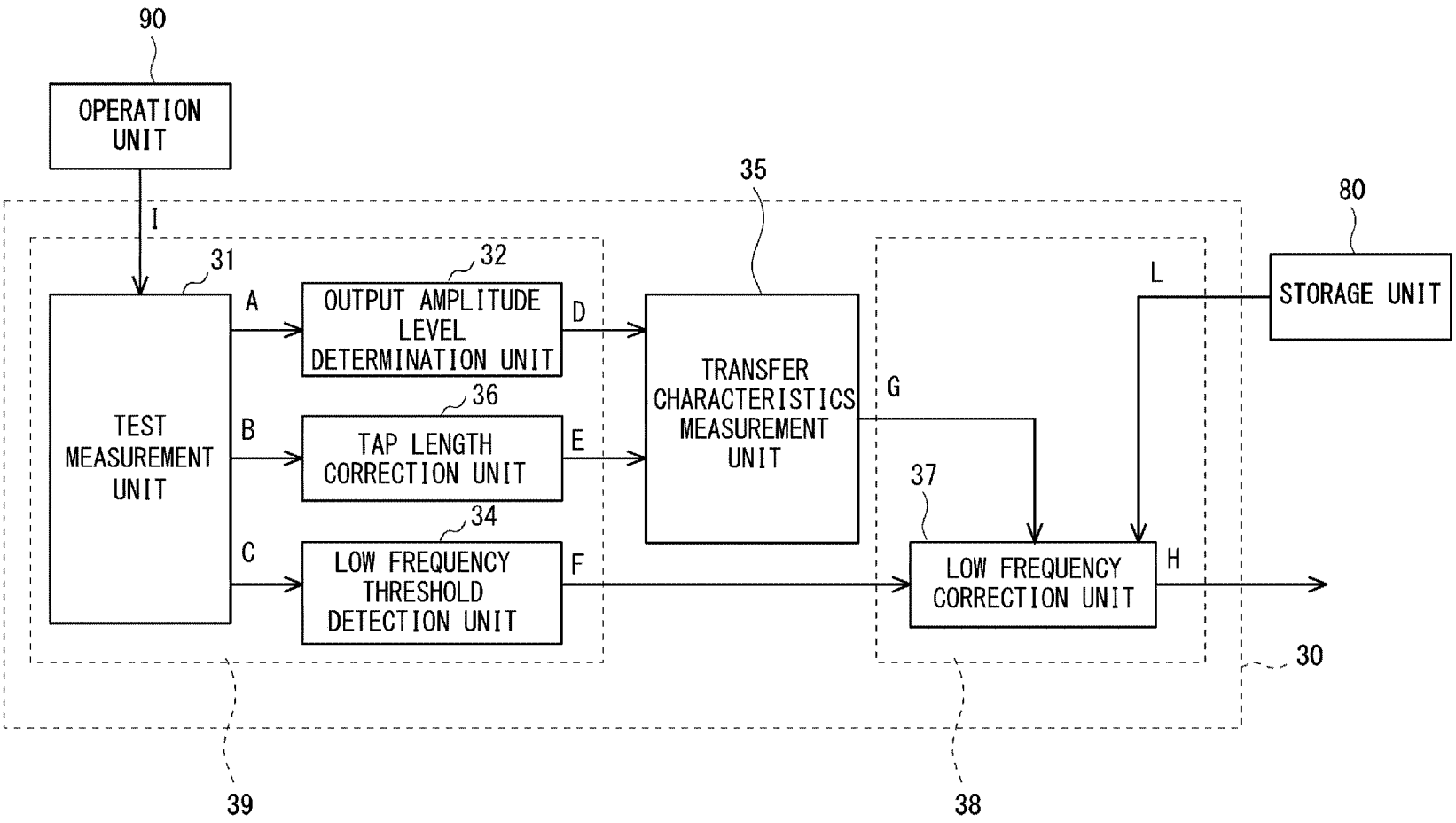
FIG. 16 is a control block diagram showing a measurement unit of an out-of-head localization device according to a second embodiment.

An out-of-head localization device according to a second embodiment is described hereinafter with reference to FIG. 16. FIG. 16 is a control block diagram showing the measurement unit 30. In the second embodiment, the tap length detection unit 33 is replaced by a tap length correction unit 36. The tap length correction unit 36 corrects the tap length p that is input by the listener 1. Then, the transfer characteristics measurement unit 35 measures the transfer characteristics by the corrected measurement tap length p. In this manner, it is possible to measure the transfer characteristics with an appropriate tap length even when unwanted reflected sounds and echoes exist if the transfer characteristics are measured with an input tap length. Note that the processing other than the tap length correction is the same as that in the first embodiment and not redundantly described. For example, the processing in the output amplitude level determination unit 32, the low frequency threshold detection unit 34 and the transfer characteristics measurement unit 35 is the same as that in the first embodiment.

Figure 17:
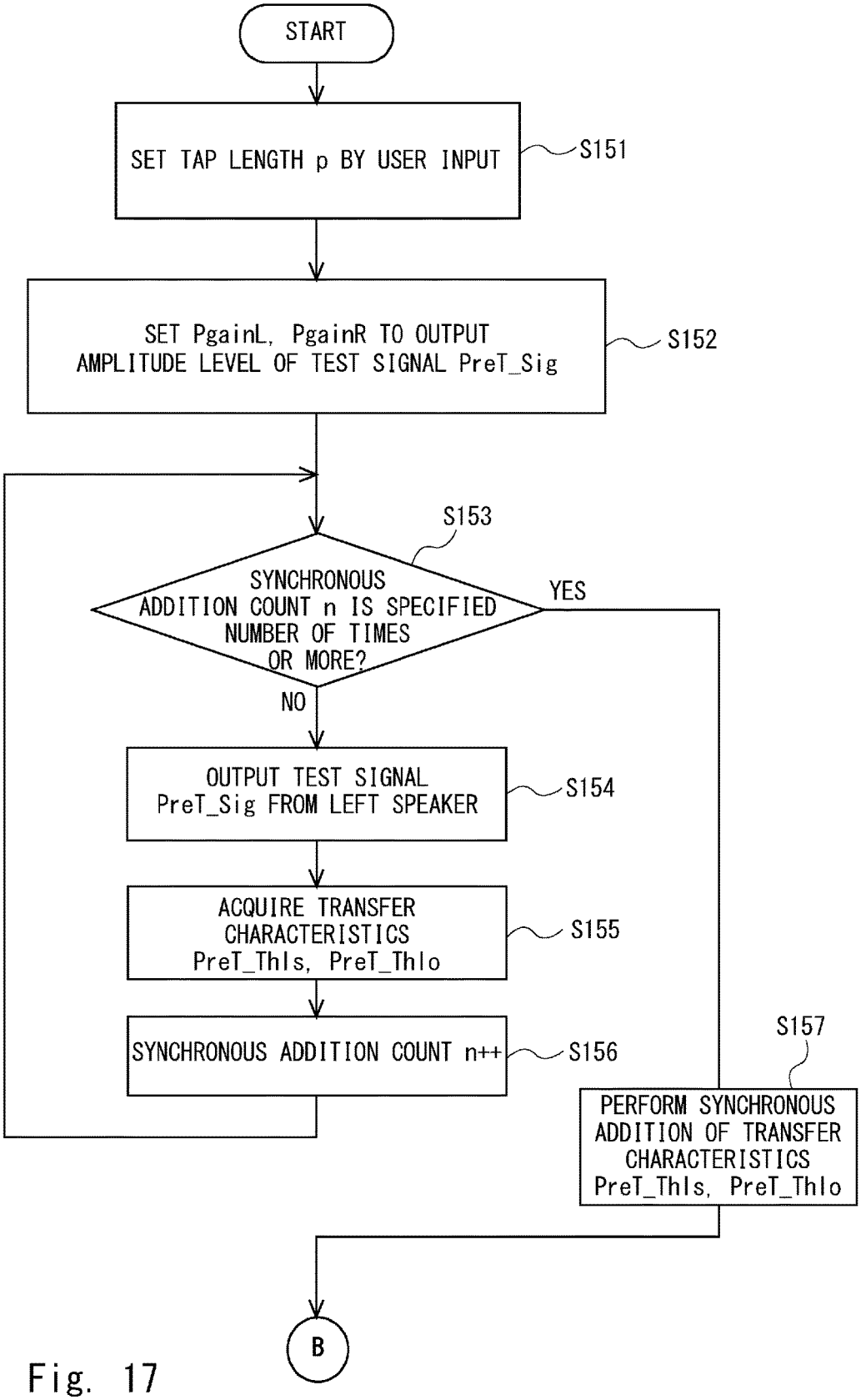
FIG. 17 is a flowchart showing a tap length correction process in a measurement unit.
Figure 18:
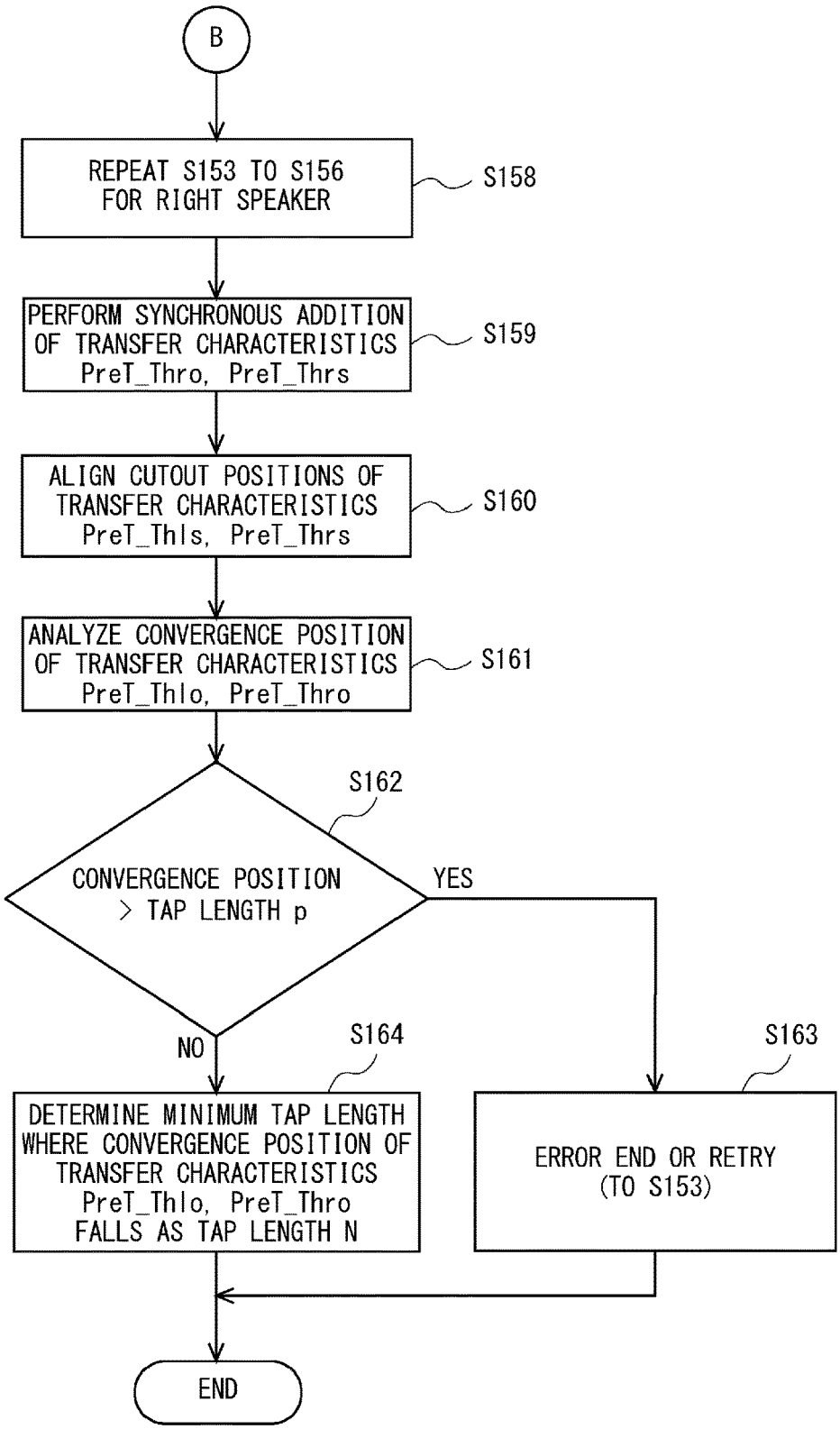
FIG. 18 is a flowchart showing a tap length correction process in a measurement unit.

The tap length correction unit 36 determines whether the tap length p that is input by the listener 1 is appropriate or not, and corrects the tap length. The tap length correction is described hereinafter with reference to FIGS. 17 and 18. FIGS. 17 and 18 are flowcharts showing the tap length correction process.

First, the test measurement unit 31 sets the tap length p by user input (S151). In this example, when the listener 1 inputs the tap length p, the operation unit 90 outputs the tap length p to the test measurement unit 31 (I in FIG. 16). The test measurement unit 31 carries out test measurement with the input tap length p. Next, PgainL and PgainR are set as the output amplitude levels of the environmental measurement signal PreT_Sig (S152). PgainL and PgainR are the output amplitude levels calculated in Step S110.

Then, the test measurement unit 31 determines whether the synchronous addition count n is equal to or more than a specified number of times (S153). Because the synchronous addition count n is less than a specified number of times (No in S153), the environmental measurement signal PreT_Sig is output from the left speaker 5L (S154). The test measurement unit 31 then acquires the transfer characteristics PreT_Thls and PreT_Thlo (S155). The transfer characteristics PreT_Thls and PreT_Thlo have the input tap length p. The synchronous addition count n is incremented (S156), and the process returns to Step S153. The processing of Steps S153 to S156 is repeated until the synchronous addition count n becomes equal to or more than a specified number of times.

When the synchronous addition count n becomes equal to or more than a specified number of times (Yes in S153), the transfer characteristics PreT_Thls and PreT_Thlo are synchronized and added (S157). Note that the processing of Steps S152 to S157 is the same as the processing of Steps S132 to S137.

After that, Steps S153 to S156 are repeated for the right speaker 5R (S158). When the synchronous addition count n becomes equal to or more than a specified number of times, the transfer characteristics PreT_Thro and PreT_Thrs are synchronized and added (S159). In this manner, the transfer characteristics PreT_Thls, PreT_Thlo, PreT_Thro and PreT_Thrs after synchronous addition can be obtained. The effects of sudden noise can be reduced by carrying out synchronous addition.

Then, the cutout positions of the transfer characteristics PreT_Thls and the transfer characteristics PreT_Thrs are aligned (S160). For example, the tap length correction unit 36 shifts the waveforms so that the peak (maximum value) positions on the direct sound side coincide. Specifically, the waveforms are shifted so that the peak (maximum value) position of the transfer characteristics PreT_Thls and the peak (maximum value) position of the transfer characteristics PreT_Thrs are at the same sample position. Then, the tap length correction unit 36 analyzes the convergence positions of the transfer characteristics PreT_Thlo and PreT_Thro after the cutout positions are aligned (S161). In this example, the tap length correction unit 36 calculates the convergence position of each of the transfer characteristics PreT_Thlo and PreT_Thro. For example, the tap length correction unit 36 sets a sample position at which the transfer characteristics fall within 5% of the peak as the convergence position, just like in Step S138.

Then, it is determined whether the convergence position of the transfer characteristics PreT_Thlo, PreT_Thro is greater than the tap length p that has been set in Step S151 (S162). When the convergence position is greater than the tap length p (Yes in S162), the process makes an error end or retry (S163). Specifically, when the convergence position is more than the tap length p, the transfer characteristics cannot be measured appropriately with the input tap length p, and therefore the occurrence of an error is informed to the listener 1 who has input the tap length p. Alternatively, the tap length correction is performed again with a longer tap length p.

On the other hand, when the convergence position is less than the tap length p (No in S162), the minimum tap length within which the convergence position of the transfer characteristics PreT_Thlo, PreT_Thro falls is determined as the measurement tap length N (S164). The tap length correction unit 36 outputs the measurement tap length N to the transfer characteristics measurement unit 35 (E in FIG. 16). The measurement tap length N is preferably the power of 2. For example, when the convergence position is 510 taps, the measurement tap length N=512. The transfer characteristics measurement unit 35 measures the transfer characteristics with the specified tap length N. It is thereby possible to measure the transfer characteristics with the appropriate measurement tap length N.

Third Embodiment

In this embodiment, the correction unit 38 includes a tap length correction unit 36. The tap length correction unit 36 corrects the tap length in the same manner as the tap length correction unit 36 in the second embodiment. Further, in this embodiment, the characteristics measured by the transfer characteristics measurement unit 35 are output to the tap length correction unit 36. The tap length correction unit 36 then corrects the tap length for the transfer characteristics measured by the transfer characteristics measurement unit 35.

Figure 19:
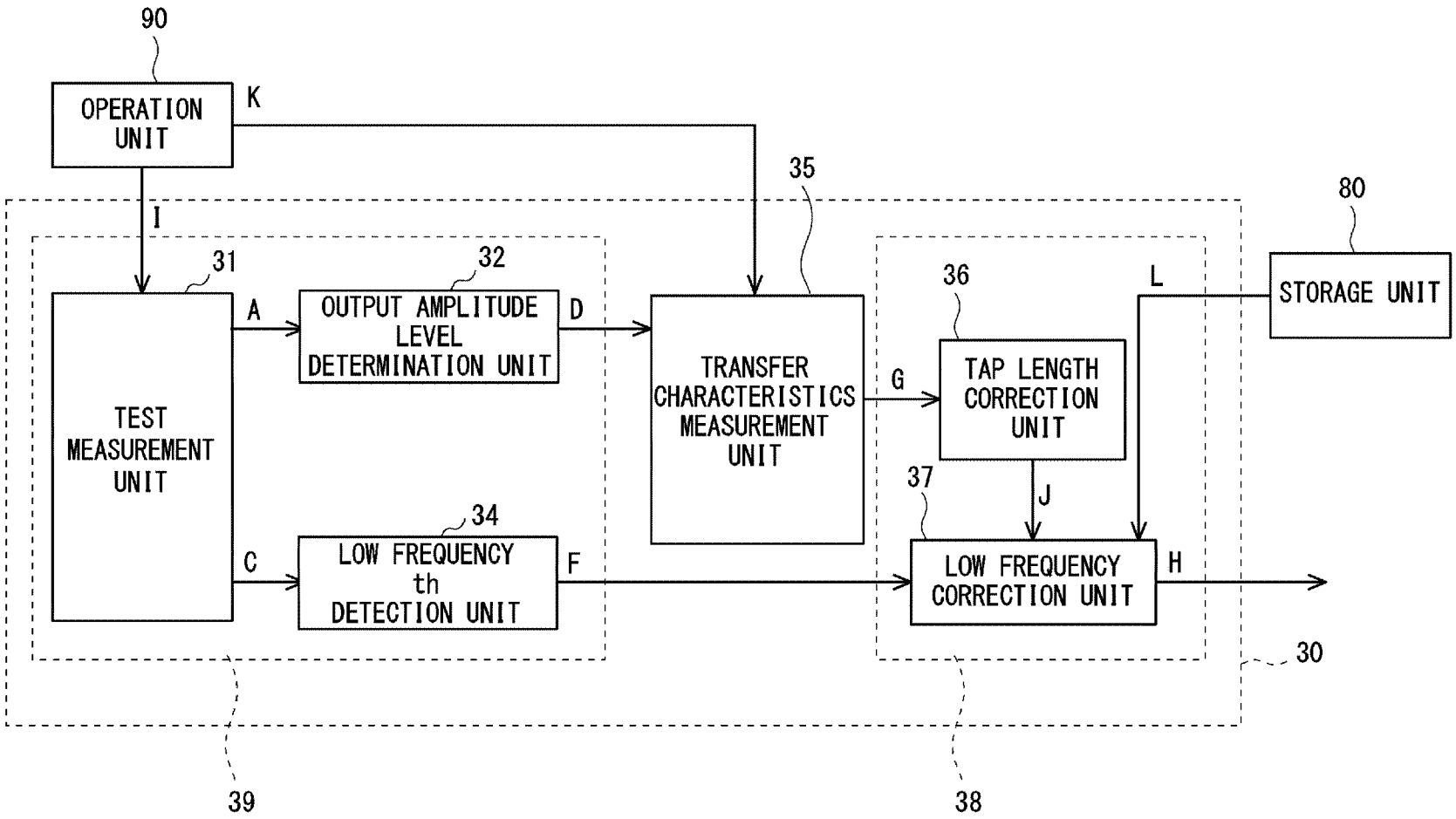
FIG. 19 is a control block diagram showing a measurement unit of an out-of-head localization device according to a third embodiment.

The operation unit 90 outputs the tap length p that is input by the listener 1 to the transfer characteristics measurement unit 35 (K in FIG. 19). The transfer characteristics measurement unit 35 measures the transfer characteristics with the tap length p that is input by the listener 1. Then, the tap length correction unit 36 determines whether the tap length with which the transfer characteristics are measured is appropriate or not, and corrects the tap length. To be specific, the tap length correction unit 36 performs the tap length correction as shown in the flowcharts of FIGS. 17 and 18. In this example, however, the tap length correction unit 36 corrects the tap length for the transfer characteristics Hls, Hlo, Hro and Hrs measured by the transfer characteristics measurement unit 35. The tap length correction unit 36 determines the tap length within which the convergence position of the transfer characteristics Hlo, Hro falls as the measurement tap length N.

The tap length correction unit 36 cuts out N samples of the measurement tap length from the transfer characteristics. Specifically, the listener 1 inputs a long tap length p in advance, and the tap length correction unit 36 cuts out a part of, i.e., the N samples of the measurement tap length of, the transfer characteristics.

Figure 20:
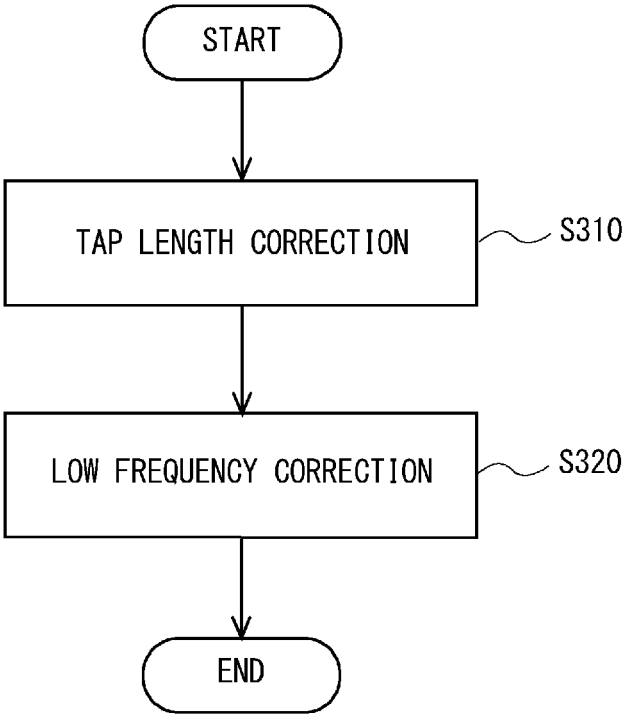
FIG. 20 is a flowchart showing details of a correction process according to the third embodiment.

The correction by the correction unit 38 is described hereinafter with reference to FIG. 20. FIG. 20 is a flowchart showing the correction process by the correction unit 38. First, the tap length correction unit 36 performs tap length correction for the transfer characteristics (S310). Then, the low frequency correction unit 37 performs low frequency correction for the transfer characteristics after the tap length correction (S320). The low frequency correction is the same as the processing shown in FIG. 15.

Figure 21:
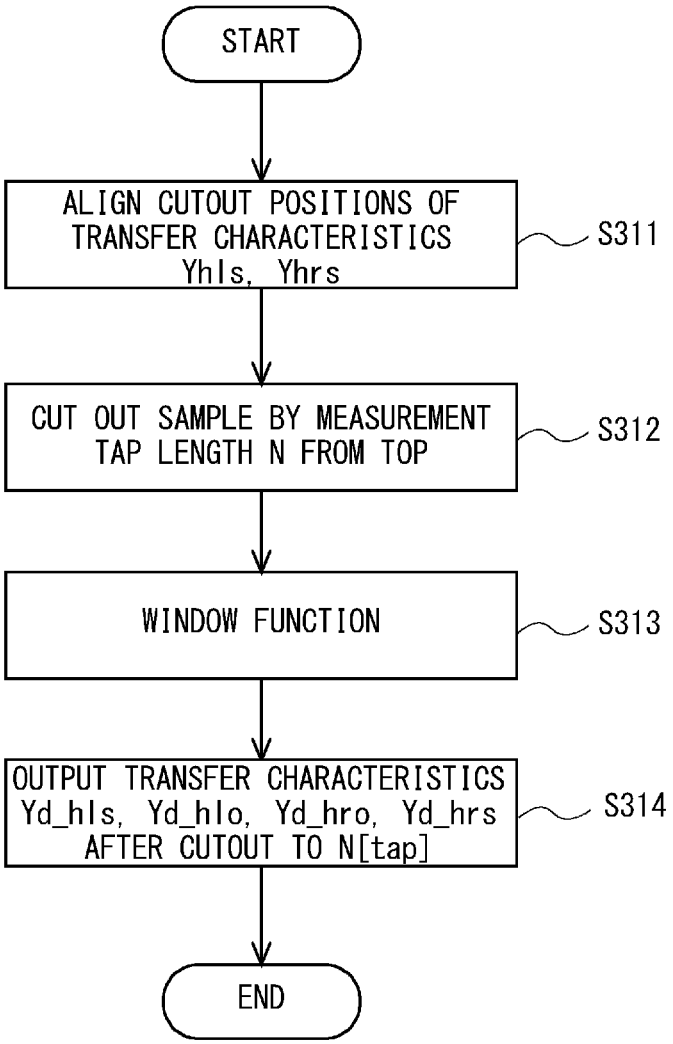
FIG. 21 is a flowchart showing details of a tap length correction process according to the third embodiment.
Figure 22:
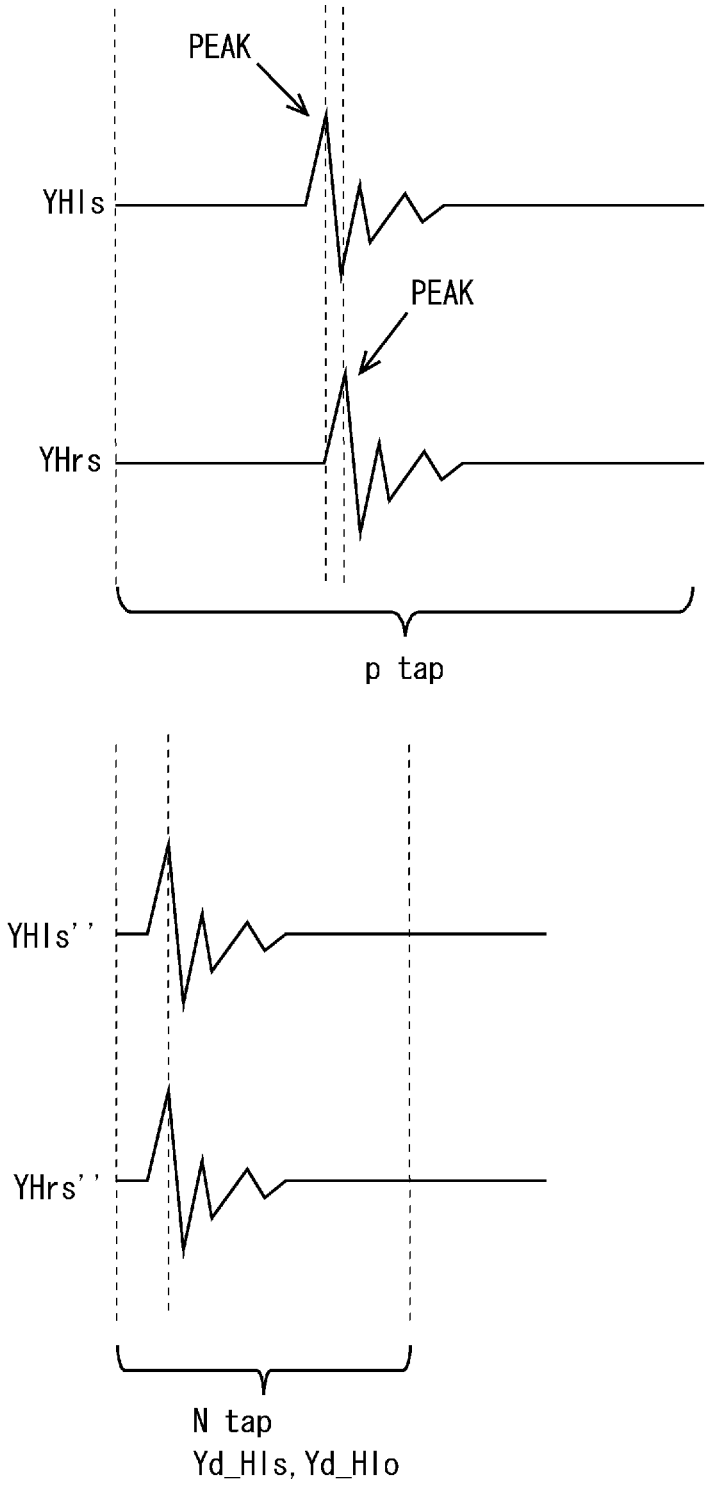
FIG. 22 is a view showing a signal waveform of processing in a tap length correction process.

The details of the tap length correction are described hereinafter with reference to FIGS. 21 and 22. FIG. 21 is a flowchart showing the tap length correction process. FIG. 22 is a view schematically showing the way of cutting out the signal waveform (transfer characteristics) in the time domain in the tap length correction process.

First, the cutout positions of the transfer characteristics Yhls and Yhrs measured by the transfer characteristics measurement unit 35 are aliened (S311). In this example, as shown in FIG. 22, the cutout positions of the waveforms are adjusted by shifting the waveforms so that the peak (maximum value) position of the transfer characteristics Yhls and the peak (maximum value) position of the transfer characteristics Yhrs are at the same sample position. The transfer characteristics Yhls and Yhlo after the adjustment of cutout positions are shown as transfer characteristics Yhls" and Yhlo".

Next, N samples of the measurement tap length are cut out from the top of the transfer characteristics Yhls and Yhrs (S312). For example, the transfer characteristics of 512 taps are cutout from the top. Note that a tap length to be cut out is preferably a power of 2. As shown n FIG. 22, the transfer characteristics after N samples of the measurement tap length are cut out are referred to as transfer characteristics Yd_hls, Yd_hlo, Yd_hro and Yd_hrs. Each of the cutout transfer characteristics Yd_hls, Yd_hlo, Yd_hro and Yd_hrs is composed of N number of digital values.

Then, the cutout transfer characteristics Yd_hls, Yd_hlo, Yd_hro and Yd_hrs are processed by the window function (S313). Specifically, the cutout transfer characteristics Yd_hls, Yd_hlo, Yd_hro and Yd_hrs are multiplied by the coefficient of the window function. The tap length correction unit 36 outputs the cutout transfer characteristics Yd_hls, Yd_hlo, Yd_hro and Yd_hrs corresponding to N samples of the measurement tap length to the low frequency correction unit 37 (S314). The low frequency correction unit 37 then corrects the filter value in the low frequency range as described earlier.

It is thereby possible to acquire the transfer characteristics with an appropriate number of taps (number of samples). The out-of-head localization unit 10 can thereby perform out-of-head localization appropriately.

Fourth Embodiment

Figure 23:
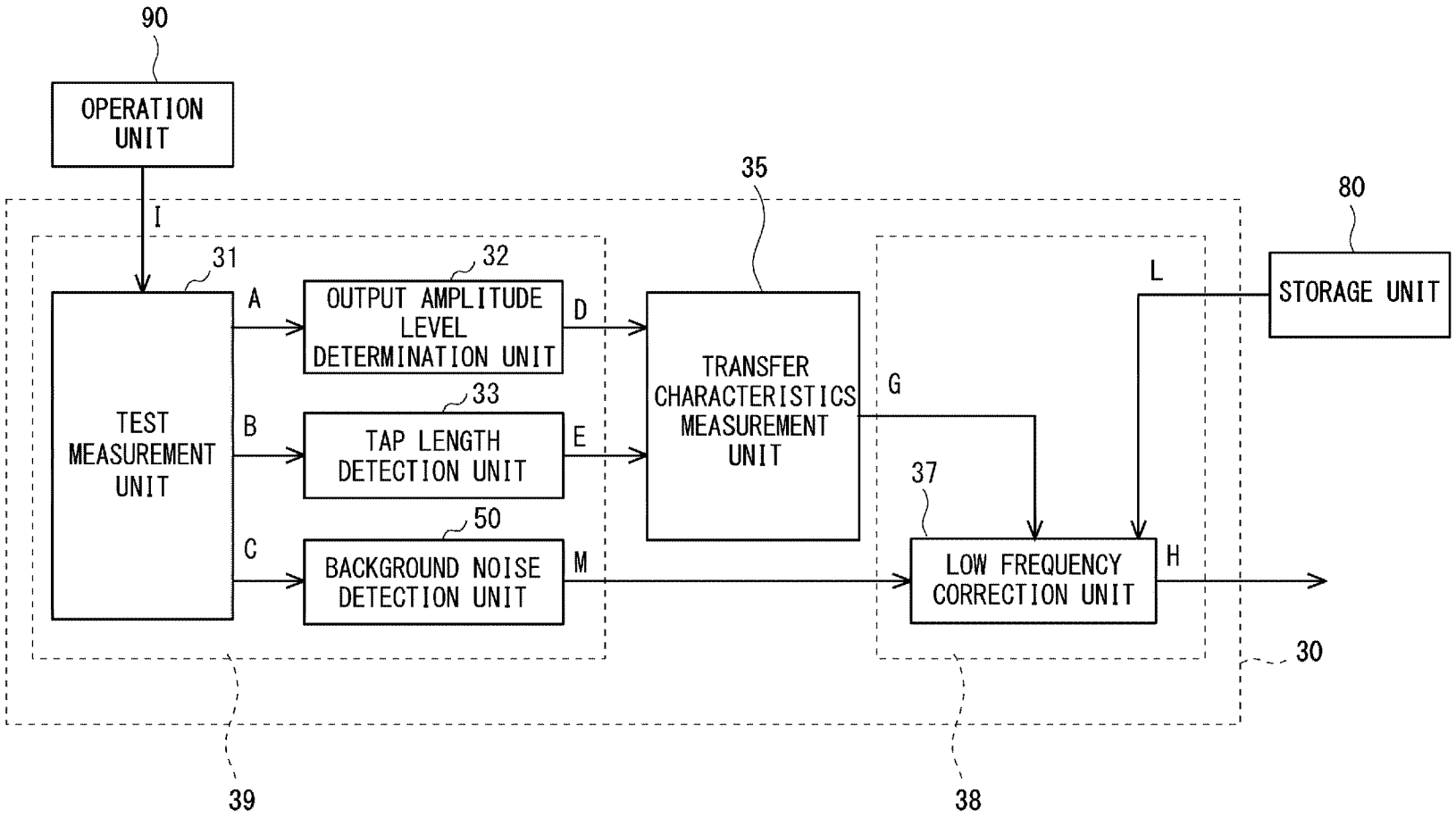
FIG. 23 is a control block diagram showing a measurement unit of an out-of-head localization device according to a fourth embodiment.

The out-of-head localization device 100 according to this embodiment is described hereinafter with reference to FIG. 23. FIG. 23 is a control block diagram showing the structure of the measurement unit 30 in the out-of-head localization device 100 according to this embodiment. In this embodiment, the low frequency threshold detection unit 34 is replaced by a background noise detection unit 50. Further, the processing by the low frequency correction unit 37 is different from that in the first embodiment. Note that the processing other than that performed by the background noise detection unit 50 and the low frequency correction unit 37 is the same as that in the first embodiment and not redundantly described.

Figure 24:
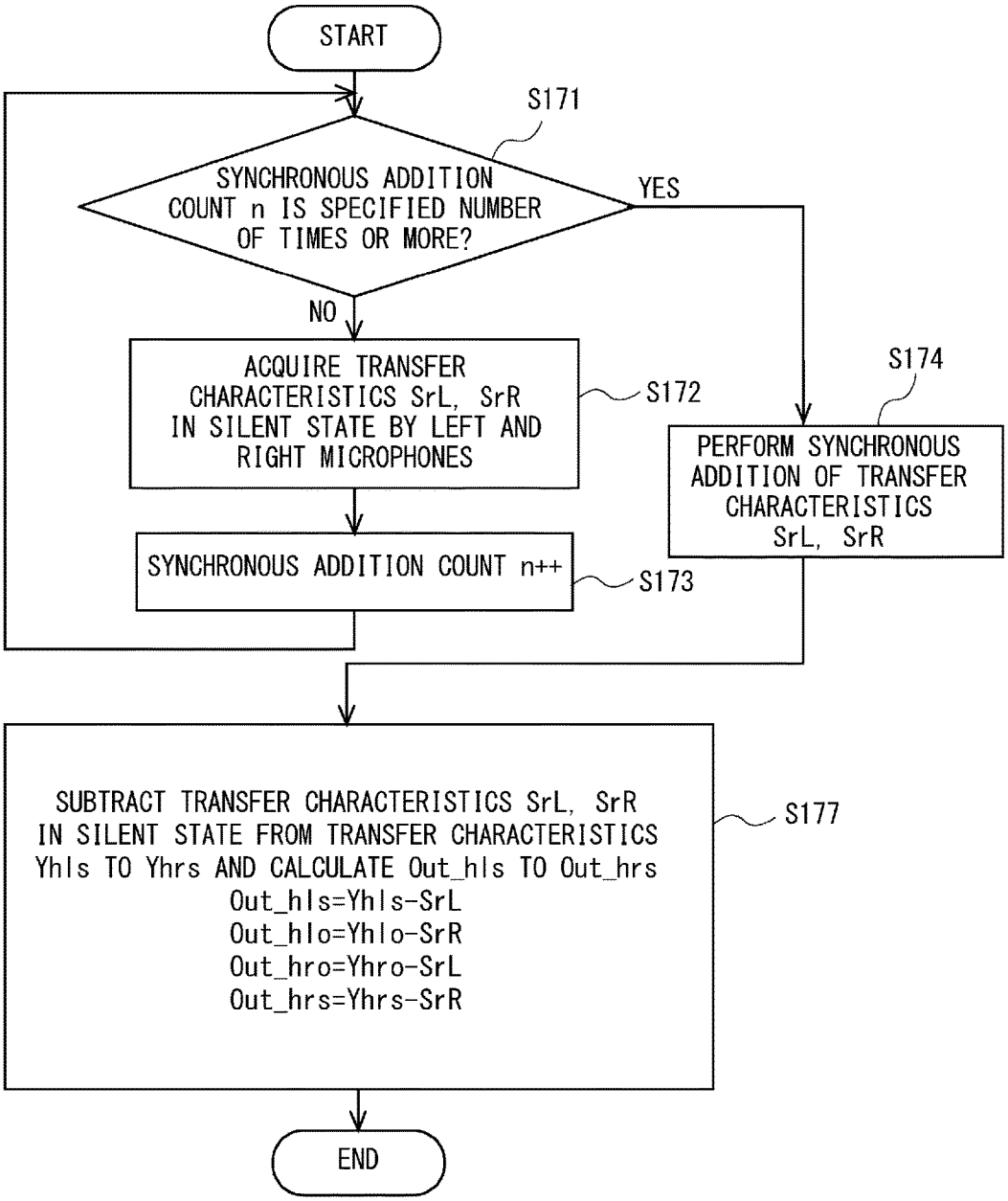
FIG. 24 is a flowchart showing a process according to the fourth embodiment.

The processing by the background noise detection unit 50 and the low frequency correction unit 37 is described hereinafter with reference to FIG. 24. FIG. 24 is a flowchart showing the process performed in the background noise detection unit 50 and the low frequency correction unit 37.

First, the background noise detection unit 50 acquires, by synchronous addition, the transfer characteristics SrL and SrR in the silent state where the transfer characteristics measurement signal is not output. As the transfer characteristics SrL and SrR acquired in this step, a signal peculiar to a measurement environment containing background noise can be acquired. The background noise detection unit 50 determines whether the synchronous addition count n is equal to or more than a specified number of times (S171). Because the synchronous addition count n is less than a specified number of times (No in S171), the left and right microphones 2L and 2R acquire the transfer characteristics SrL and SrR in the silent state (S172). The synchronous addition count n is incremented (S173), and the process returns to Step S171. Steps S171 to S173 are repeated until the synchronous addition count n becomes equal to or more than a specified number of times.

When the synchronous addition count n becomes equal to or more than a specified number of times (Yes in S171), the transfer characteristics SrL and SrR are synchronized and added (S174). The processing up to this step is the same as in FIG. 12. After that, the transfer characteristics SrL and SrR in the silent state are subtracted from the transfer characteristics Yhls to Yhrs, and thereby Out_hls to Out_hrs are calculated (S177).

To be specific, the background noise detection unit 50 outputs the transfer characteristics SrL and SrR in the silent state as background noise to the low frequency correction unit 37 (M in FIG. 23). The transfer characteristics measurement unit 35 outputs the transfer characteristics Yhls, Yhlo, Yhro and Yhrs to the low frequency correction unit 37 (G in FIG. 23). Note that the transfer characteristics Yhls, Yhlo, Yhro and Yhrs and the transfer characteristics SrL and SrR in the silent state are synchronized and added the same number of times.

The transfer characteristics Outhls=Yhls-SrL, and the transfer characteristics Outhro=Yhro-SrL. Further, the transfer characteristics Outhlo=Yhlo-SrR, and the transfer characteristics Outhrs=Yhrs-SrR. In this manner, the correction unit 38 subtracts the transfer characteristics SrL and SrR in the silent state, which is background noise, from the measured transfer characteristics Yhls to Yhrs.

Even in the silent state, there is background noise in the low frequency range. Thus, the low frequency range can be corrected by subtracting the transfer characteristics SrL and SrR in the silent state from the measured transfer characteristics Yhls to Yhrs. Specifically, the effects of background noise in the low frequency range are reduced in the transfer characteristics Outhls to Outhrs. It is thereby possible to obtain the transfer characteristics with reduced effects of background noise. Then, the out-of-head localization unit 10 carries out convolution by using the transfer characteristics with corrected low frequencies. It is thereby possible to perform out-of-head localization appropriately.

Note that the above-described first to fourth embodiments can be combined as appropriate. For example, the low frequency correction in the fourth embodiment can be combined with the second or third embodiment. Further, in the above-described first to fourth embodiments, the order of processing and measurement is not particularly limited. For example, measurement in the silent state may be carried out after measurement of the transfer characteristics.

As described above, in the first to fourth embodiments, the out-of-head localization device 100 includes the left and right speakers 5L and 5R, the left and right microphones 2L and 2R that pick up sounds output from the left and right speakers 5L and 5R, the transfer characteristics measurement unit 35 that measures transfer characteristics, the out-of-head localization unit 10 that carries out out-of-head localization on a reproduction signal by using the transfer characteristics and outputs the signal to the left and right speakers, and the environmental measurement unit 39. The transfer characteristics measurement unit 35 measures the transfer characteristics from the left and right speakers 5L and 5R to the left and right microphones 2L and 2R by picking up the transfer characteristics measurement signals that are output from the left and right speakers 5L and 5R with use of the left and right microphones 2L and 2R, respectively.

Then, the environmental measurement unit 39 picks up the environmental measurement signals that are output from the left and right speakers 5L and 5R with use of the left and right microphones 2L and 2R, and thereby performs environmental measurement for setting the transfer characteristics measurement signals. Based on measurement results in the environmental measurement unit 39, the output amplitude levels of the transfer characteristics measurement signals and the tap length of the transfer characteristics are set. The environmental measurement unit 39 carries out measurement in the silent state where no measurement signal is output from the left and right speakers, and based on measurement results in the silent state, the low frequency range of the transfer characteristics measured by the transfer characteristics measurement unit 35 is corrected.

Because appropriate transfer characteristics can be obtained in the above manner, it is thus possible to perform out-of-head localization appropriately. Specifically, it is possible to measure the transfer characteristics with appropriate measurement tap length and appropriate output amplitude level. Further, the low frequency range of the transfer characteristics is corrected by the transfer characteristics in the silent state. The effects of background noise can be thereby reduced from the transfer characteristics. It is thereby possible to perform convolution processing using appropriate transfer characteristics.

Further, in the first to third embodiments, a low frequency threshold is set based on measurement results in the silent state. Then, in a low frequency range that is lower than the low frequency threshold, the filter value of the transfer characteristics is corrected, and in a high frequency range that is higher than the low frequency threshold, the filter value of the transfer characteristics measured by the transfer characteristics measurement unit is used without any modification. It is thereby possible to correct the transfer characteristics easily and appropriately. Further, in a low frequency range that is lower than the low frequency threshold, the filter value of the transfer characteristics is replaced with a filter value that is previously stored in the storage unit 80. It is thereby possible to correct the transfer characteristics easily.

In the fourth embodiment, the transfer characteristics are corrected by subtracting the transfer characteristics measured in the silent state from the transfer characteristics measured by the transfer characteristics measurement unit 35. The effects of background noise can be thereby reduced from the transfer characteristics. It is thereby possible to perform convolution processing using appropriate transfer characteristics.

Further, in the first and second embodiments, the measurement tap length of the transfer characteristics is set based on the convergence time of the environmental measurement signals picked up by the left and right microphones. It is thereby possible to obtain the transfer characteristics with an appropriate tap length.

It should be noted that, although the out-of-head localization device that localizes sound images outside the head by using headphones is described as a sound localization device in the first to fourth embodiment, this embodiment is not limited to the out-of-head localization device. For example, it may be used for a sound localization device that reproduces stereo signals from the speakers 5L and 5R and localizes sound images. Specifically, this embodiment is applicable to a sound localization device that convolves transfer characteristics to reproduction signals.

A part or the whole of the above-described signal processing may be executed by a computer program. The above-described program can be stored and provided to the computer using any type of non-transitory computer readable medium. The non-transitory computer readable medium includes any type of tangible storage medium. Examples of the non-transitory computer readable medium include magnetic storage media (such as floppy disks, magnetic tapes, hard disk drives, etc.), optical magnetic storage media (e.g. magneto-optical disks), CD-ROM (Read Only Memory), CD-R, CD-R/W, DVD-ROM (Digital Versatile Disc Read Only Memory), DVD-R (DVD Recordable)), DVD-R DL (DVD-R Dual Layer)), DVD-RW (DVD ReWritable)), DVD-RAM), DVD+R), DVR+R DL), DVD+RW), BD-R (Blu-ray (registered trademark) Disc Recordable)), BD-RE (Blu-ray (registered trademark) Disc Rewritable)), BD-ROM), and semiconductor memories (such as mask ROM, PROM (Programmable ROM), EPROM (Erasable PROM), flash ROM, RAM (Random Access Memory), etc.). The program may be provided to a computer using any type of transitory computer readable medium. Examples of the transitory computer readable medium include electric signals, optical signals, and electromagnetic waves. The transitory computer readable medium can provide the program to a computer via a wired communication line such as an electric wire or optical fiber or a wireless communication line.

Although embodiments of the invention made by the present invention are described in the foregoing, the present invention is not restricted to the above-described embodiments, and various changes and modifications may be made without departing from the scope of the invention.

The present application is applicable to a sound localization device that localizes sound images by using transfer characteristics.

What is claimed is:

1. A measurement device comprising:

a transfer characteristics measurement unit configured to measure first transfer characteristics from left and right sound sources to left and right microphones, respectively, by picking up transfer characteristics measurement signals output from the left and right sound sources by use of the left and right microphones;

an environmental measurement unit configured to perform first environmental measurement that picks up environmental measurement signals output from the left and right sound sources by use of the left and right microphones and second environmental measurement that picks up sounds by use of the left and right microphones in a state where no sound is output from the left and right sound sources, sets an amplitude level of the transfer characteristics measurement signals and a tap length of the first transfer characteristics based on results of the first environmental measurement, and measures second transfer characteristics based on results of the second environmental measurement; and a correction unit configured to correct a low frequency range of the first transfer characteristics based on the second transfer characteristics.

2. The measurement device according to claim 1, wherein the environmental measurement unit sets a threshold for a frequency of the first transfer characteristics based on the second transfer characteristics, and the correction unit corrects the first transfer characteristics in a frequency range lower than the threshold, and uses the first transfer characteristics in a frequency range higher than the threshold.

3. The measurement device according to claim 2, wherein the correction unit replaces the first transfer characteristics with previously stored transfer characteristics in a frequency range lower than the threshold.

4. The measurement device according to claim 1, wherein the correction unit corrects the first transfer characteristics by subtracting the second transfer characteristics from the first transfer characteristics.

5. The measurement device according to claim 1, wherein the environmental measurement unit sets the tap length based on a sample position where the environmental measurement signals picked up by the left and right microphones converge.

6. A measurement method for measuring first transfer characteristics between left and right sound sources and left and right microphones, the method comprising:

an environmental measurement step of performing first environmental measurement that picks up environmental measurement signals output from the left and right sound sources by use of the left and right microphones and second environmental measurement that picks up sounds by use of the left and right microphones in a state where no sound is output from the left and right sound sources, setting an amplitude level of transfer characteristics measurement signals and a tap length of the first transfer characteristics from the left and right sound sources to the left and right microphones based on results of the first environmental measurement, and measuring second transfer characteristics based on results of the second environmental measurement;

a transfer characteristics measurement step of measuring the first transfer characteristics by outputting, from the left and right sound sources, the transfer characteristics measurement signals set based on results of the first environmental measurement, and picking up the transfer characteristics measurement signals by use of the left and right microphones, respectively; and a correction step of correcting a low frequency range of the first transfer characteristics based on the second transfer characteristics.

7. The measurement method according to claim 6, wherein the environmental measurement step sets a threshold for a frequency of the first transfer characteristics based on the second transfer characteristics, and the correction step corrects the first transfer characteristics in a frequency range lower than the threshold, and uses the first transfer characteristics in a frequency range higher than the threshold.

8. The measurement method according to claim 7, wherein the correction step replaces the first transfer characteristics with previously stored transfer characteristics in a frequency range lower than the threshold.

9. The measurement method according to claim 6, wherein the correction step corrects the first transfer characteristics by subtracting the second transfer characteristics from the first transfer characteristics.

10. The measurement method according to claim 6, wherein the environmental measurement step sets the tap length based on a sample position where the environmental measurement signals picked up by the left and right microphones converge.

* * * * *